US010287158B2

(12) United States Patent
Taylor

(10) Patent No.: US 10,287,158 B2
(45) Date of Patent: May 14, 2019

(54) SAFETY DEVICE FOR REINS

(71) Applicant: Daniel Peter Taylor, East Windsor, NJ (US)

(72) Inventor: Daniel Peter Taylor, East Windsor, NJ (US)

( * ) Notice: Subject to any disclaimer, the term of this patent is extended or adjusted under 35 U.S.C. 154(b) by 302 days.

(21) Appl. No.: 15/347,082

(22) Filed: Nov. 9, 2016

(65) Prior Publication Data

US 2018/0127262 A1 May 10, 2018

(51) Int. Cl.
*B68B 5/06* (2006.01)

(52) U.S. Cl.
CPC ..... *B68B 5/06* (2013.01)

(58) Field of Classification Search
CPC ..... B68B 1/04; B68B 2001/046; B68B 2001/048; B68B 5/00; B68B 5/06
See application file for complete search history.

(56) References Cited

U.S. PATENT DOCUMENTS

| | | | | |
|---|---|---|---|---|
| 2,717,437 | A | 9/1955 | De Mestral | |
| 3,009,235 | A | 11/1961 | De Mestral | |
| 4,472,925 | A | 9/1984 | Woodruff | |
| 4,519,187 | A | 5/1985 | Reynolds | |
| 4,627,126 | A | 12/1986 | Nichols | |
| 4,813,213 | A | 3/1989 | Nickowski | |
| 5,029,434 | A | 7/1991 | Erickson | |
| 5,148,656 | A | 9/1992 | Meaghan | |
| 5,284,005 | A | 2/1994 | Jacobi | |
| 5,771,843 | A | 6/1998 | Karlin | |
| 5,966,911 | A | 10/1999 | Gray et al. | |
| 6,098,384 | A * | 8/2000 | Porrello | B68B 5/00 54/36 |
| 6,151,872 | A | 11/2000 | Rasmussen | |
| 6,264,755 | B1 | 7/2001 | Georgiou | |
| 6,516,593 | B2 | 2/2003 | Markle | |
| 6,553,747 | B1 | 4/2003 | Texel | |
| 6,591,589 | B2 | 7/2003 | Cook | |
| 6,591,590 | B1 * | 7/2003 | Henneberg | A41D 19/01552 473/205 |
| 6,813,872 | B2 | 11/2004 | Gray | |
| 7,490,457 | B1 * | 2/2009 | Peck | B68B 1/04 54/36 |
| 8,001,750 | B2 | 8/2011 | Howard | |
| 8,454,035 | B2 | 6/2013 | Watson | |
| 8,523,200 | B2 | 9/2013 | Hayden | |
| 8,863,316 | B2 | 10/2014 | Gaskins | |

(Continued)

FOREIGN PATENT DOCUMENTS

| | | | | |
|---|---|---|---|---|
| DE | 29509174 U1 * | 8/1995 | | A01K 27/003 |
| DE | 29509174 U1 | 8/1995 | | |

(Continued)

OTHER PUBLICATIONS

Machine translation of DE 202011105589 to Druecker, published Nov. 2011.*

*Primary Examiner* — Kathleen I Alker
(74) *Attorney, Agent, or Firm* — Paul & Paul

(57) ABSTRACT

A safety device for use with reins for guiding a horse, includes a releasable fastener that allows the ends of the reins to separate in order to reduce the chance that a rider or driver entangled in the reins will be dragged on the ground by the horse or a horse drawn vehicle. The illustrative embodiment of the safety device employs a hook-and-loop fastener.

26 Claims, 18 Drawing Sheets

(56) References Cited

U.S. PATENT DOCUMENTS

| | | | | |
|---|---|---|---|---|
| 9,815,255 | B2 * | 11/2017 | Mills | A01K 13/007 |
| 2004/0159082 | A1 * | 8/2004 | Gray | B68B 1/04 54/36 |
| 2006/0107626 | A1 | 5/2006 | Wilson | |
| 2015/0307342 | A1 * | 10/2015 | Pierce | B68B 1/00 54/71 |

FOREIGN PATENT DOCUMENTS

| | | | | |
|---|---|---|---|---|
| DE | 202011105589 | U1 * | 11/2011 | B68B 1/04 |
| DE | 202011105589 | U1 | 11/2011 | |
| DE | 202013003414 | U1 * | 5/2013 | B68B 1/04 |
| DE | 202013003414 | U1 | 5/2013 | |

* cited by examiner

SAFETY DEVICE FOR REINS

BACKGROUND OF THE INVENTION

1. Field of the Invention

The present invention relates to a system and device to mitigate the potential for serious injury due to a fallen rider or driver being dragged by a horse or horse-drawn vehicle.

2. Description of the Prior Art

Equestrian sports such as harness racing, thoroughbred horse racing, steeplechase, show jumping, and other equestrian events have a very long tradition. In such sports, riders of horses or drivers of horse-drawn vehicles use control lines, sometimes referred to as reins that are usually connected to the horse's bridle, in the case of bitless bridles such as a hackamore for example, or to a bit in the horse's mouth, to directionally control and guide the horse to the left or the right or to stop the horse. This is usually accomplished with at least two control lines, one for the right direction and one for the left direction. To reduce the chance that the rider or driver will lose control of one or more of the control lines, the terminal ends of the control lines near where they are normally held by the rider, jockey, or driver are connected together. A harness racing sulky used in harness racing is illustrated in U.S. Pat. No. 5,966,911, issued to Gray et al. on Oct. 19, 1999, which is incorporated by reference herein in its entirety. Heretofore, the terminal ends of the control lines near where they are normally held by the driver of the sulky have been connected together by a connector having a central swivel, two short strap portions connected to each side of the swivel, and a buckle connected to the end of each strap. An example of this type of connector is shown in FIGS. 1-2. The terminal ends of the control lines have holes for engagement by the buckles 51 of the connector 50. The connection provided by the prior art connector can withstand a great deal of tensile force without allowing the terminal ends of the control lines to separate. All too frequently, if a fallen driver has one or both legs or other extremity entangled in the control lines, the fallen driver will be dragged to his or her death or will suffer grievous injury because the prior art connector will not allow the terminal ends of the control lines to separate and release the fallen driver.

A similar problem exists in horseback riding and horseracing. The traditional control lines for these sports are connected using a buckle as illustrated in U.S. Pat. No. 5,148,656, issued to Meaghan on Sep. 22, 1992, which is incorporated by reference herein in its entirety. This type of connector 52 is also illustrated in FIGS. 3-4. Again, the terminal ends of the control lines, near where they are held by the rider, are connected by a buckle that will not allow the ends of the control lines to separate and release a fallen rider, which entails the risk of death or severe injury.

The problem outlined above has persisted for decades, perhaps centuries, with no known attempt at finding a solution. The need persists in the art for a safety device that will mitigate the potential for serious injury due to a fallen rider or driver being dragged by a horse or horse drawn vehicle.

SUMMARY OF THE INVENTION

The present invention is directed to a safety device for use with reins for equestrian sports. The safety device uses at least one hook-and-loop fastener for connecting ends of the control lines for guiding a horse such that the ends of the control lines will separate and thereby stop a fallen rider or driver from being dragged by a horse or a horse drawn vehicle.

The present invention also encompasses a safety connector that is capable of being retrofit to existing rein systems for equestrian sports. The safety connector uses at least one hook-and-loop fastener for connecting ends of the control lines for guiding a horse such that the ends of the control lines will separate and thereby stop a fallen rider or driver from being dragged by a horse or a horse drawn vehicle. For convenience of reference, the portion of each control line that includes the end that connects to the bit or the bridle, or is otherwise operably linked or connected to the headgear of the horse, in order to communicate control commands from the rider or driver to the horse, is referred to herein as the head portion of the control line.

It is an aspect of the present invention to provide a safety connector or device for use with the control lines for guiding a horse, wherein the safety device includes a releasable fastener system.

It is an aspect of the present invention to provide a safety connector or device for use with control lines for guiding a horse, the control lines including at least a first control line and a second control line, the first control line having a head portion, the second control line having a head portion, the first control line being usable for guiding the horse to the left, the second control line being usable for guiding the horse to the right, the safety device comprising:

a first strap portion operably connected to one of the head portion of the first control line and the head portion of the second control line;

a second strap portion operably connected to the other of the head portion of the first control line and the head portion of the second control line;

a first portion of a hook-and-loop fastener attached to the first strap portion, the first portion of the hook-and-loop fastener being in the form of a panel lying flat against one side of the first strap portion;

a second portion of a hook-and-loop fastener attached to the second strap portion, the second portion of the hook-and-loop fastener being in the form of a panel lying flat against one side of the second strap portion; and wherein a threshold tensile force required to separate the first strap portion and the second strap portion is lower than the tensile force that would be placed on the control lines for guiding a horse if a rider or driver entangled in the control lines for guiding a horse were to be dragged on the ground by the horse or a horse drawn vehicle.

It is another aspect of the present invention to provide a safety connector or device for use with control lines for guiding a horse, the control lines including at least a first control line and a second control line, the first control line having a head portion, the second control line having a head portion, the first control line being usable for guiding the horse to the left, the second control line being usable for guiding the horse to the right, the safety connector comprising:

a swivel having a first ring and a second ring;

a first strap portion attached to the first ring;

a second strap portion attached to the second ring;

a first portion of hook-and-loop fastener attached to the first strap portion, the first portion of hook-and-loop fastener being in the form of a panel lying flat against one side of the first strap portion;

a complementary portion of hook-and-loop fastener adapted for attachment to a third strap portion, the complementary portion of hook-and-loop fastener being complementary to the first portion of hook-and-loop fastener, the third strap portion being operably connected to one of the head portion of the first control line and the head portion of the second control line, the complementary portion of hook-and-loop fastener being in the form of a panel that can lie flat against one side of the third strap portion when the complementary portion of hook-and-loop fastener is attached to the third strap portion; and wherein, when the complementary portion of hook-and-loop fastener is attached to the third strap portion and the first portion of hook-and-loop fastener is fastened to the complementary portion of hook-and-loop fastener, a threshold tensile force required to separate the first strap portion and the third strap portion is lower than the tensile force that would be placed on the control lines for guiding a horse if a rider or driver entangled in the control lines for guiding a horse were to be dragged on the ground by the horse or a horse drawn vehicle.

It is yet another aspect of the present invention to provide a safety connector or device incorporating any aspect of the present invention as previously described herein, wherein the first and second rings of the swivel are rotationally connected by a pivot pin, wherein the first and second rings can rotate freely relative to one another, wherein the pivot pin has a journal portion having a longitudinal axis, wherein at least one of the first and second rings rotates about the journal portion of the pivot pin, wherein the longitudinal axis of the journal portion of the pivot pin about which at least one of first and second rings rotates defines the axis of rotation of the first and second rings relative to one another, where the first and second rings are positioned side by side along the axis of rotation defined by the pivot pin with the first and second rings being positioned in tandem one after the other in a direction coincident with the axis of rotation defined by the pivot pin, wherein each of the first and second rings defines a respective opening, and wherein the axis of rotation defined by the pivot pin approximately bisects the opening of each of the first and second rings.

It is yet another aspect of the present invention to provide a safety connector or device incorporating any aspect of the present invention as previously described herein, wherein the safety connector further comprises at least one keeper.

It is yet another aspect of the present invention to provide a safety device or connector for use with control lines for guiding a horse, the control lines including at least a first control line and a second control line, the first control line having a head portion, the second control line having a head portion, the safety device comprising:

a first strap portion adapted to be operably connected to one of the head portion of the first control line and the head portion of the second control line;

a first portion of a hook-and-loop fastener attached to the first strap portion, the first portion of the hook-and-loop fastener being in the form of a panel lying flat against one side of the first strap portion;

a second portion of a hook-and-loop fastener adapted for attachment to a second strap portion, the second portion of the hook-and-loop fastener being in the form of a panel lying flat against one side of the second strap portion, wherein the second strap portion is operably connected to the other of the head portion of the first control line and the head portion of the second control line, wherein the second strap portion is part of the control lines for guiding a horse, and wherein, when the first strap portion is operably connected to a corresponding one of the head portion of the first control line and the head portion of the second control line, the first portion of a hook-and-loop fastener can be engaged to the second portion of a hook-and-loop fastener to releasably secure the first strap portion to the second strap portion; and wherein a threshold tensile force required to separate the first strap portion and the second strap portion is lower than the tensile force that would be placed on the control lines for guiding a horse if a rider or driver entangled in the control lines for guiding a horse were to be dragged on the ground by the horse or a horse drawn vehicle.

It is yet another aspect of the present invention to provide a safety device or connector incorporating any aspect of the present invention as previously described herein, wherein the safety device or connector further comprises:

a third strap portion adapted to be operably connected to the one of the head portion of the first control line and the head portion of the second control line to which the first strap portion is adapted for connection;

a third portion of a hook-and-loop fastener attached to the third strap portion, the third portion of the hook-and-loop fastener being in the form of a panel lying flat against one side of the third strap portion; and a forth portion of a hook-and-loop fastener adapted for attachment to the second strap portion, the fourth portion of the hook-and-loop fastener being in the form of a panel lying flat against one side of the second strap portion that is opposite the side of the second strap portion to which the second portion of a hook-and-loop fastener is attached, wherein the second strap portion can be received between the first strap portion and the third strap portion, the first portion of a hook-and-loop fastener can be engaged to the second portion of a hook-and-loop fastener, and the third portion of a hook-and-loop fastener can be engaged to the fourth portion of a hook-and-loop fastener in order to releasably secure the second strap portion to the first strap portion and the third strap portion, and wherein a threshold tensile force required to separate the second strap portion from the first strap portion and the third strap portion is lower than the tensile force that would be placed on the control lines for guiding a horse if a rider or driver entangled in the control lines for guiding a horse were to be dragged on the ground by the horse or a horse drawn vehicle.

It is yet another aspect of the present invention to provide a safety device or connector incorporating any aspect of the present invention as previously described herein, wherein the third portion of a hook-and-loop fastener is provided on a side of the third strap portion that faces the first strap portion, and wherein the first portion of a hook-and-loop fastener is provided on a side of the first strap portion that faces the third strap portion.

It is yet another aspect of the present invention to provide a safety device or connector incorporating any aspect of the present invention as previously described herein, wherein the second strap portion is operably connected to the head portion of the second control line and the first strap portion and the third strap portion are adapted for operable connection to the head portion of the first control line, the safety device or connector further comprising:

a swivel comprising a first ring and a second ring that are rotatably connected to one another;

a first intermediate strap portion connecting the first strap portion to the third strap portion, wherein the first intermediate strap portion is routed through the first ring and its end portions secured together to thereby pivotally attach the first strap portion and the third strap portion to the first ring, wherein the first strap portion and the third strap portion form a forked arrangement for receiving the second strap portion between them;

a fourth strap portion;

a fifth strap portion;

a second intermediate strap portion connecting the fourth strap portion to the fifth strap portion, wherein the second intermediate strap portion is routed through the second ring and its end portions secured together to thereby pivotally attach the fourth strap portion and the fifth strap portion to the second ring, wherein the fourth strap portion and the fifth strap portion form a forked arrangement for receiving a sixth strap portion between them, wherein the sixth strap portion is operably connected to the head portion of the first control line and wherein the sixth strap portion is part of the control lines for guiding a horse;

a fifth portion of a hook-and-loop fastener attached to the fourth strap portion, the fifth portion of the hook-and-loop fastener being in the form of a panel lying flat against one side of the fourth strap portion;

a sixth portion of a hook-and-loop fastener attached to the fifth strap portion, the sixth portion of the hook-and-loop fastener being in the form of a panel lying flat against one side of the fifth strap portion;

a seventh portion of a hook-and-loop fastener adapted for attachment to one side of the sixth strap portion, the seventh portion of the hook-and-loop fastener being in the form of a panel lying flat against the one side of the sixth strap portion; and an eighth portion of a hook-and-loop fastener adapted for attachment to an opposite side of the sixth strap portion relative to the seventh portion of a hook-and-loop fastener, the eighth portion of the hook-and-loop fastener being in the form of a panel lying flat against the opposite side of the sixth strap portion, wherein, when the second portion of a hook-and-loop fastener and the fourth portion of a hook-and-loop fastener are attached to the second strap portion and when the seventh portion of a hook-and-loop fastener and the eighth portion of a hook-and-loop fastener are attached to the sixth strap portion, the first portion of a hook-and-loop fastener can be engaged to the second portion of a hook-and-loop fastener, the third portion of a hook-and-loop fastener can be engaged to the fourth portion of a hook-and-loop fastener, the fifth portion of a hook-and-loop fastener can be engaged to the seventh portion of a hook-and-loop fastener, and the sixth portion of a hook-and-loop fastener can be engaged to the eighth portion of a hook-and-loop fastener to releasably secure the second strap portion to the sixth strap portion and to releasably secure the sixth strap portion to the fourth and fifth strap portions, and wherein, when the second strap portion is releasably secured to the sixth strap portion, a threshold tensile force required to separate the sixth strap portion from the second strap portion is lower than the tensile force that would be placed on the control lines for guiding a horse if a rider or driver entangled in the control lines for guiding a horse were to be dragged on the ground by the horse or the horse drawn vehicle.

It is yet another aspect of the present invention to provide a safety device or connector incorporating any aspect of the present invention as previously described herein, wherein, when the sixth strap portion is releasably secured to the fourth and fifth strap portions, a threshold tensile force required to separate the sixth strap portion from the fourth strap portion and the fifth strap portion is lower than the tensile force that would be placed on the control lines for guiding a horse if a rider or driver entangled in the control lines for guiding a horse were to be dragged on the ground by the horse or the horse drawn vehicle.

It is yet another aspect of the present invention to provide a safety device or connector incorporating any aspect of the present invention as previously described herein, wherein the third portion of a hook-and-loop fastener is provided on a side of the third strap portion that faces the first strap portion, and wherein the first portion of a hook-and-loop fastener is provided on a side of the first strap portion that faces the third strap portion, and wherein the fifth portion of a hook-and-loop fastener is provided on a side of the fourth strap portion that faces the fifth strap portion, and wherein the sixth portion of a hook-and-loop fastener is provided on a side of the fifth strap portion that faces the fourth strap portion.

It is yet another aspect of the present invention to provide a safety device or connector incorporating any aspect of the present invention as previously described herein, wherein the safety device or connector further comprises:

a first keeper secured to the first strap portion such that the third strap portion and the second strap portion extend through the first keeper when the second portion of a hook-and-loop fastener and the fourth portion of a hook-and-loop fastener are attached to the second strap portion, the first portion of a hook-and-loop fastener is engaged to the second portion of a hook-and-loop fastener, and the third portion of a hook-and-loop fastener is engaged to the fourth portion of a hook-and-loop fastener; and a second keeper secured to the fourth strap portion such that the fifth strap portion and the sixth strap portion extend through the second keeper when the seventh portion of a hook-and-loop fastener and the eighth portion of a hook-and-loop fastener are attached to the sixth strap portion, the fifth portion of a hook-and-loop fastener is engaged to the seventh portion of a hook-and-loop fastener, and the sixth portion of a hook-and-loop fastener is engaged to the eighth portion of a hook-and-loop fastener.

It is yet another aspect of the present invention to provide a safety device or connector incorporating any aspect of the present invention as previously described herein, wherein the first keeper is secured to the first strap portion at a fixed location along the first strap portion, and wherein the second keeper is secured to the fourth strap portion at a fixed location along the fourth strap portion.

It is yet another aspect of the present invention to provide a safety device or connector incorporating any aspect of the present invention as previously described herein, wherein the first keeper is captured between the side of the first strap portion that is opposite the side to which the first portion of a hook-and-loop fastener is attached and a first strip that is attached to the first strap portion at the first strip's end portions, and wherein the second keeper is captured between the side of the fourth strap portion that is opposite the side to which the fifth portion of a hook-and-loop fastener is attached and a second strip that is attached to the fourth strap portion at the second strip's end portions.

It is yet another aspect of the present invention to provide a safety device or connector incorporating any aspect of the present invention as previously described herein, wherein the first keeper is movable along at least a portion of the first strap portion, and wherein the second keeper is movable along at least a portion of the fourth strap portion.

It is yet another aspect of the present invention to provide a safety device or connector incorporating any aspect of the present invention as previously described herein, wherein the first keeper is captured between the side of the first strap portion that is opposite the side to which the first portion of a hook-and-loop fastener is attached and a first elongated strip that is attached to the first strap portion at the first elongated strip's end portions, and wherein the second keeper is captured between the side of the fourth strap portion that is opposite the side to which the fifth portion of a hook-and-loop fastener is attached and a second elongated strip that is attached to the fourth strap portion at the second elongated strip's end portions.

These and other aspects of the present invention will be made clearer upon study of the detailed description of the invention provided below and the appended drawings.

BRIEF DESCRIPTION OF THE DRAWINGS

The same reference characters denote the corresponding features consistently throughout the attached drawings.

DETAILED DESCRIPTION OF THE PREFERRED EMBODIMENTS

Figure 1:
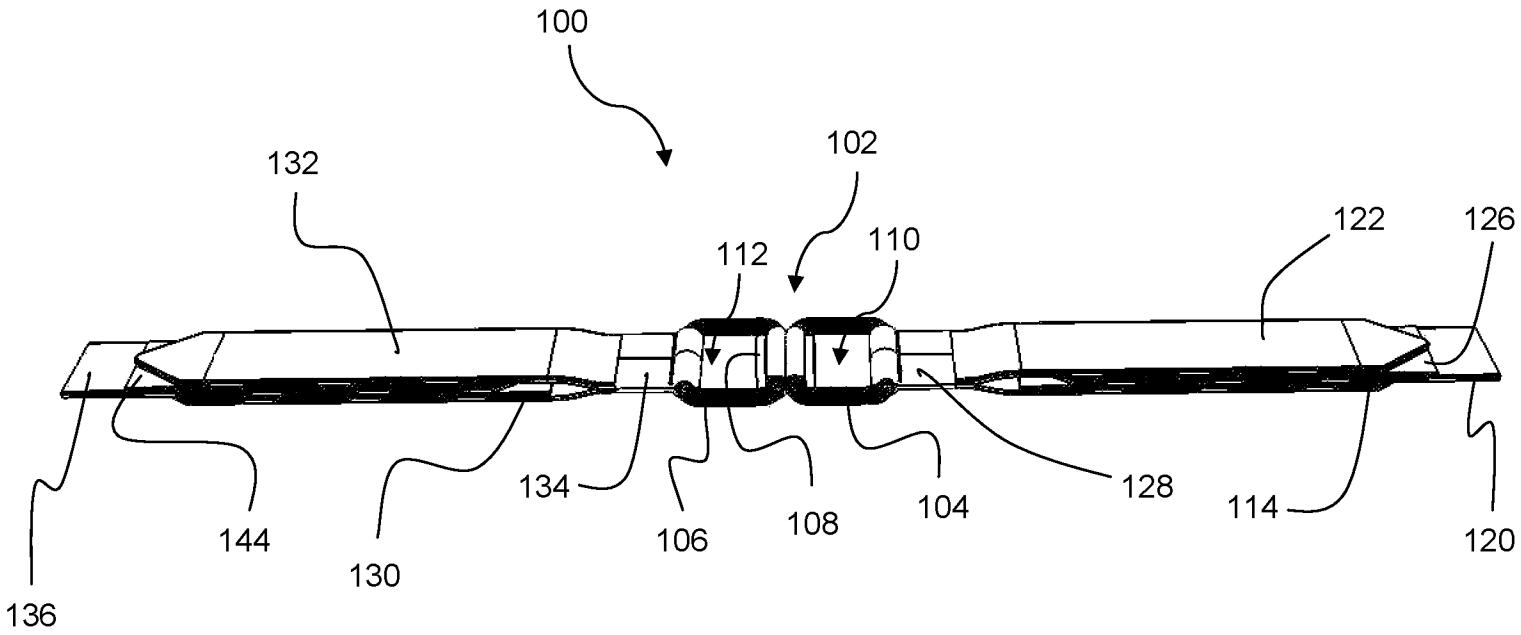
FIGS. 1-6 are views of a first embodiment of a safety device for connecting the ends of the control lines for controlling and guiding a horse in accordance with the present invention.
Figure 2:
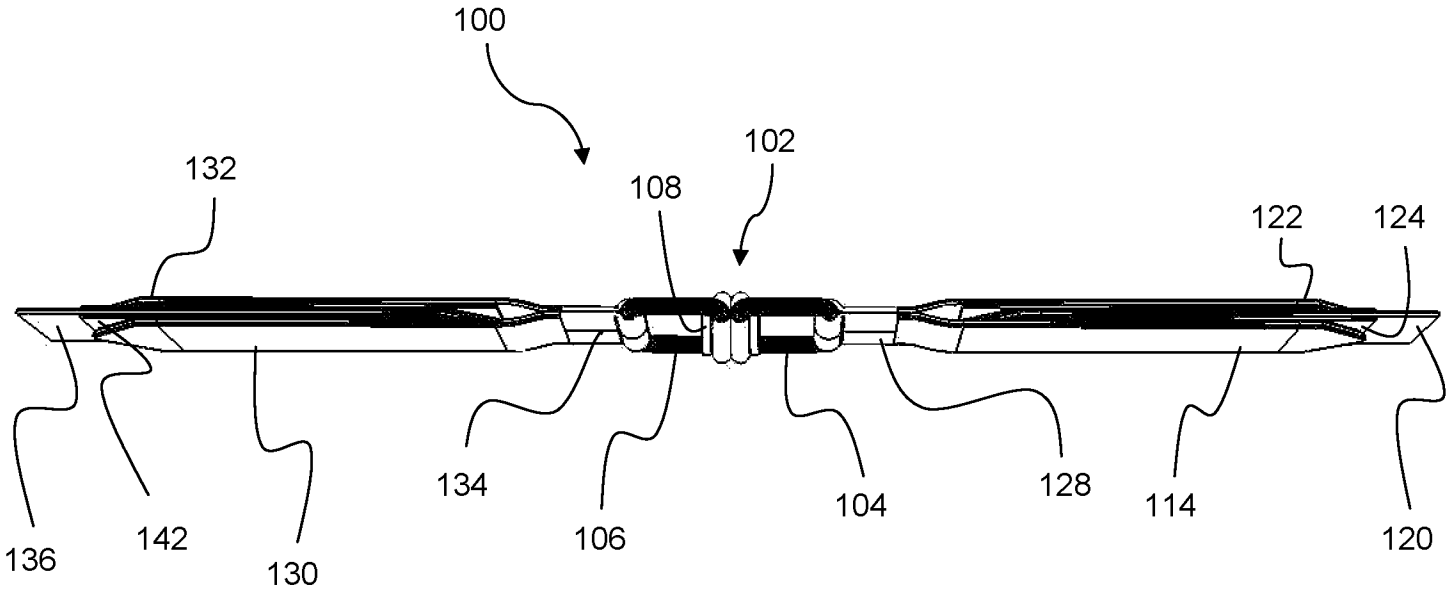
Figure 3:
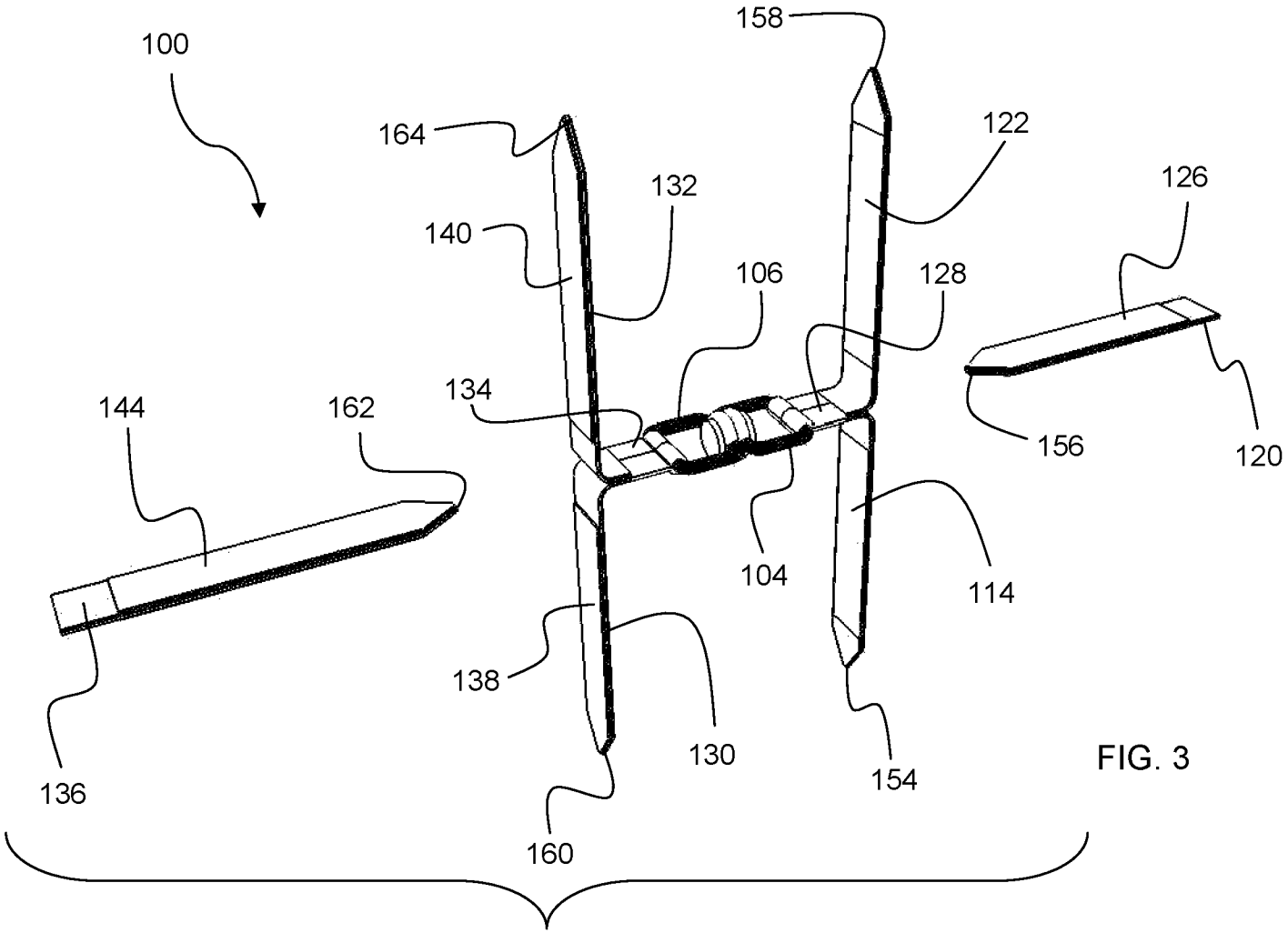
Figure 4:
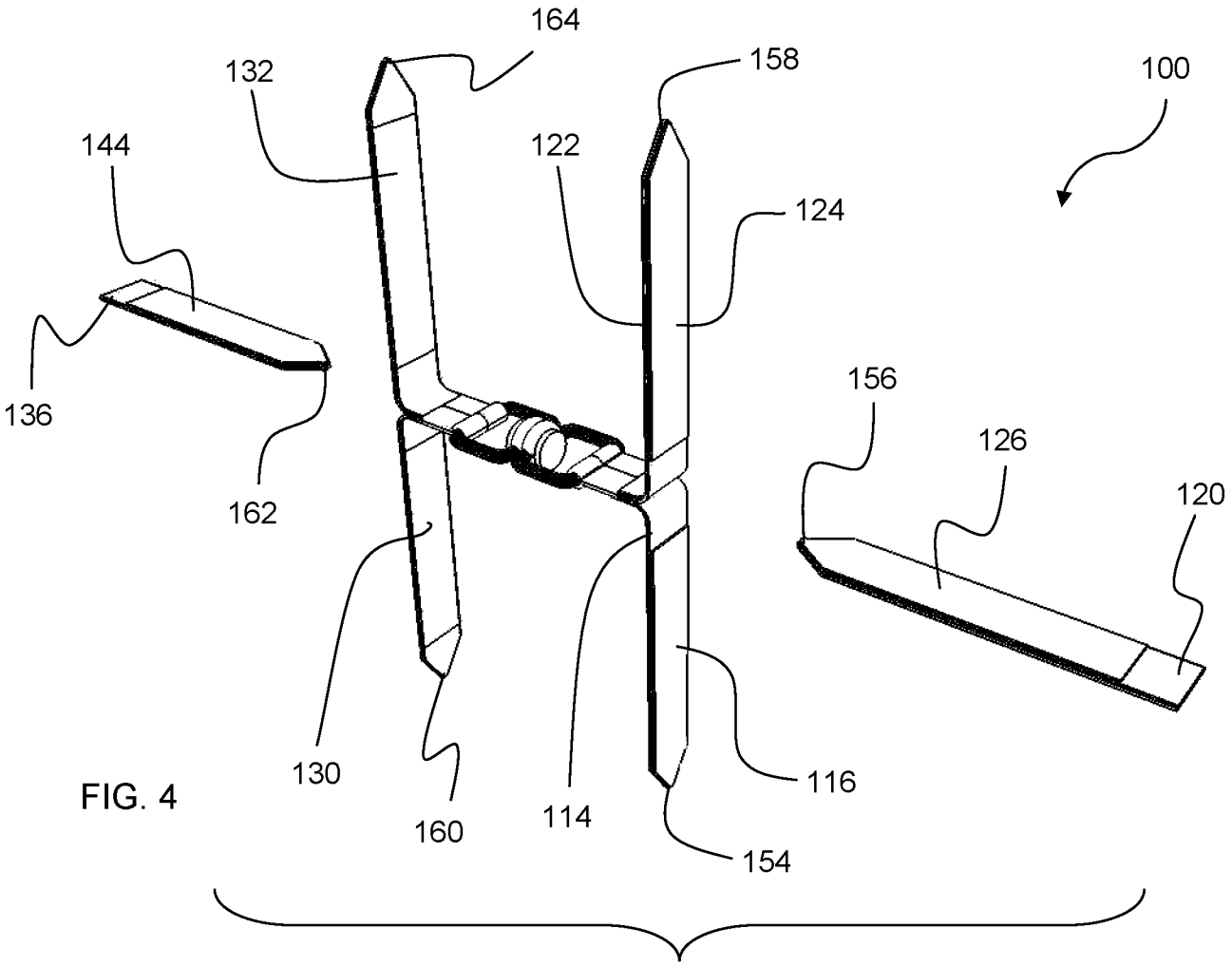
Figure 5:
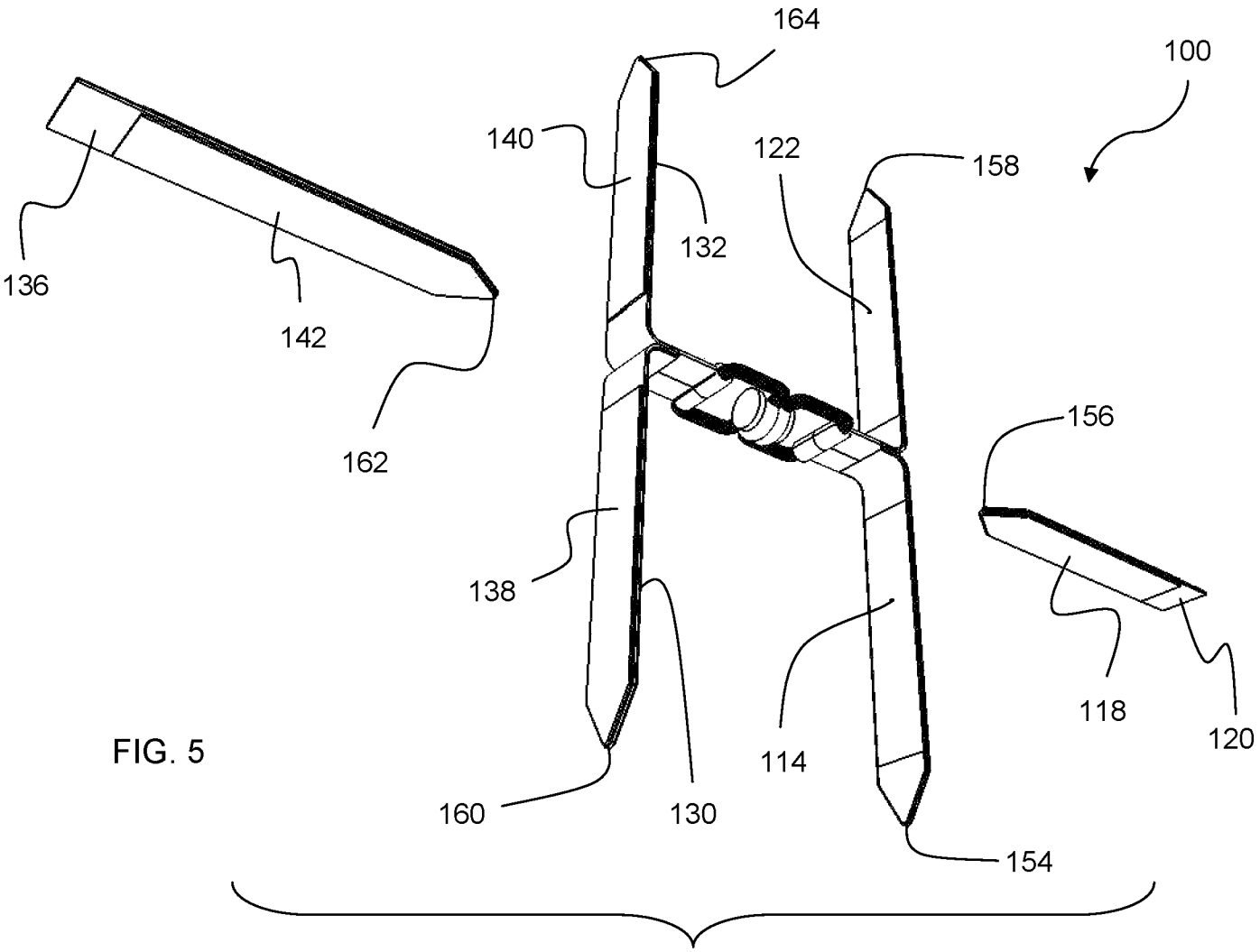
Figure 6:
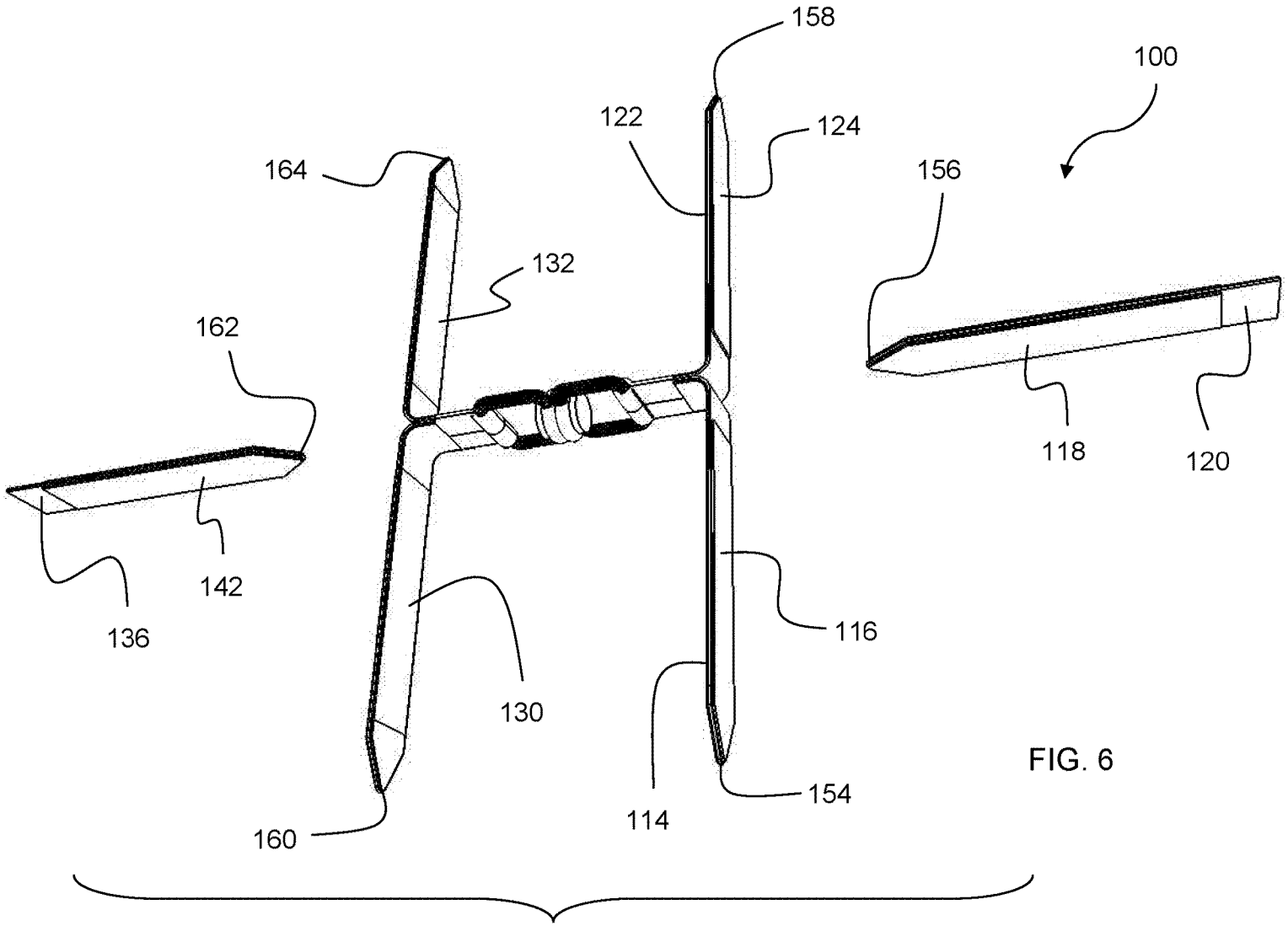

Referring to FIGS. 1-6, a first embodiment 100 of a safety device according to the present invention can be seen. The safety device 100 is a safety connector for connecting the ends of the control lines for controlling and guiding a horse. The safety device 100 includes a swivel 102. The swivel 102 includes two rings 104, 106 that are rotationally connected by a pivot pin 108. The rings 104, 106 can rotate freely relative to one another. The longitudinal axis of the journal portion of the pivot pin 108 about which at least one of the rings 104, 106 rotates defines the axis of rotation of the rings 104, 106 relative to one another. The rings 104, 106 are positioned side by side along the axis of rotation defined by the pivot pin 108 with the rings 104, 106 being positioned in tandem one after the other in a direction coincident with the axis of rotation defined by the pivot pin 108. Each ring 104, 106 defines an opening 110, 112, and the axis of rotation defined by the pivot pin approximately bisects the opening of each of the rings 104, 106. In the illustrated embodiment, the pivot pin 108 is formed by a rivet that is free to rotate relative to both rings. However, the pivot pin 108 may be fixed to one of the rings 104, 106, while the other ring is free to rotate about the pivot pin 108.

The safety device 100 includes a first strap portion 114 that is adapted to be operably connected to one of the control lines for controlling and guiding a horse. The first strap portion 114 is pivotally attached to the first ring 104. The safety device 100 includes a first portion of a hook-and-loop fastener 116 that is attached to the first strap portion 114. The first portion of a hook-and-loop fastener 116 is in the form of a panel lying flat against one side of the first strap portion 114.

The safety device 100 includes a second portion of a hook-and-loop fastener 118 adapted for attachment to a second strap portion 120. The second portion of hook-and-loop fastener 118 is in the form of a panel lying flat against one side of the second strap portion 120. The second strap portion 120 is operably connected to the one of the control lines for controlling and guiding a horse that is other than the control line that would be connected to the first strap portion 114 in use. The second strap portion 120 is part of the control lines for controlling and guiding a horse.

With the second hook-and-loop fastener portion 118 attached to the second strap portion 120, such as by sewing or adhesive attachment, and the first strap portion 114 connected to the control line for controlling and guiding a horse other than the one connected to the strap portion 120, the first hook-and-loop fastener portion 116 can be engaged to the second hook-and-loop fastener portion 118 to releasably secure together the ends of the control lines for controlling and guiding a horse. The threshold tensile force required to separate the ends of the control lines for controlling and guiding a horse that are attached together by the safety connector 100 is well below the tensile force that would be placed on the control lines if a rider or driver entangled in the control lines were to be dragged on the ground by a horse or a horse drawn vehicle.

The control lines usually include at least a first control line, for example for guiding the horse to the left, and a second control line, for example for guiding the horse to the right. The first control line usually has a head portion (not shown) that attaches to the bridle, bit, or snaffle provided on or about the horse's head. Similarly, the second control line usually has a head portion (not shown) that attaches to the bridle, bit, or snaffle provided on or about the horse's head. The tail end of the control line is the end of the control line that is closest to where the rider or driver usually grasps the control line. In the illustrated example, the strap portion 136 corresponds to the tail end of the first control line, while the strap portion 120 corresponds to the tail end of the second control line.

The safety device 100 further comprises a third strap portion 122, a third portion of a hook-and-loop fastener 124, and a forth portion of a hook-and-loop fastener 126. The third strap portion 122 is adapted to be operably connected to the head portion of the same control line as the first strap portion 114. The third portion of a hook-and-loop fastener 124 is attached to the third strap portion 122. The third portion of the hook-and-loop fastener 124 is in the form of a panel lying flat against one side of the third strap portion 122. The forth portion of a hook-and-loop fastener 126 is adapted for attachment to the second strap portion 120. The fourth portion of the hook-and-loop fastener 126 is in the form of a panel lying flat against the side of the second strap portion 120 that is opposite the side of the second strap portion 120 to which the second portion of a hook-and-loop fastener 118 is attached.

The second strap portion 120 can be received between the first strap portion 114 and the third strap portion 122. The first portion of a hook-and-loop fastener 116 can be engaged to the second portion of a hook-and-loop fastener 118, and the third portion of a hook-and-loop fastener 124 can be engaged to the fourth portion of a hook-and-loop fastener 126 in order to releasably secure the second strap portion 120 to the first strap portion 114 and the third strap portion 122.

Once the second strap portion 120 is releasably secured to the first strap portion 114 and the third strap portion 122, the threshold tensile force required to separate the second strap portion 120 from the first strap portion 114 and the third strap portion 122 is lower than the tensile force that would be placed on the control lines for guiding a horse if a rider or driver entangled in the control lines for guiding a horse were to be dragged on the ground by the horse or a horse drawn vehicle. Accordingly, the second strap portion 120 will separate from the first and third strap portions 114 and 122, and thereby release an entangled rider or driver, rather than allow the rider or driver to be dragged on the ground by the horse or the horse drawn vehicle.

The third portion of a hook-and-loop fastener 124 is provided on a side of the third strap portion 122 that faces the first strap portion 114. Similarly, the first portion of a hook-and-loop fastener 116 is provided on a side of the first strap portion 114 that faces the third strap portion 122.

The second strap portion 120 is operably connected to the head portion (not shown) of the second control line and essentially is the tail end of the second control line that may be connected directly or indirectly to the head portion of the second control line. The first strap portion 114 and the third strap portion 122 are adapted for operable connection to the head portion (not shown) of the first control line. For example, the first control line may be used for guiding the horse to the left and the second control line may be used for guiding the horse to the right, or vice versa.

The safety device 100 also includes the swivel 102. The swivel 102 includes a first ring 104 and a second ring 106 that are rotatably connected to one another as has already been described. The first strap portion 114 and the third strap portion 122 are attached to the first ring 104, and the first strap portion 114 and the third strap portion 122 can receive the second strap portion 120 between them. The safety device 100 also includes a first intermediate strap portion 128 connecting the first strap portion 114 to the third strap portion 122. The first intermediate strap portion 128 is routed through the first ring 104 and its end portions are secured together, for example by being stitched or sewn together, to thereby pivotally attach the first strap portion 114 and the third strap portion 122 to the first ring 104. The first strap portion 114 and the third strap portion 122 form a forked arrangement for receiving the second strap portion 120 between them.

The safety device 100 also includes a fourth strap portion 130 and a fifth strap portion 132. The fourth strap portion 130 and the fifth strap portion 132 are attached to the second ring 106, and the fourth strap portion 130 and the fifth strap portion 132 can receive a sixth strap portion 136 between them. A second intermediate strap portion 134 connects the fourth strap portion 130 to the fifth strap portion 132. The second intermediate strap portion 134 is routed through the second ring 106 and its end portions are secured together, for example by being stitched or sewn together, to thereby pivotally attach the fourth strap portion 130 and the fifth strap portion 132 to the second ring 106. The fourth strap portion 130 and the fifth strap portion 132 form a forked arrangement for receiving the sixth strap portion 136 between them. The sixth strap portion 136 is operably connected to the head portion (not shown) of the first control line and is essentially the tail end of the first control line that may be connected directly or indirectly to the head portion of the first control line. Accordingly, the sixth strap portion 136 is part of the control lines for guiding the horse.

A fifth portion of a hook-and-loop fastener 138 is attached to the fourth strap portion 130. The fifth portion of the hook-and-loop fastener 138 is in the form of a panel lying flat against one side of the fourth strap portion 130. A sixth portion of a hook-and-loop fastener 140 is attached to the fifth strap portion 132. The sixth portion of the hook-and-loop fastener 140 is in the form of a panel lying flat against one side of the fifth strap portion 132. A seventh portion of a hook-and-loop fastener 142 is adapted for attachment to one side of the sixth strap portion 136. The seventh portion of the hook-and-loop fastener 142 is in the form of a panel lying flat against one side of the sixth strap portion 136.

An eighth portion of a hook-and-loop fastener 144 is adapted for attachment to the side of the sixth strap portion 136 that is opposite the side of the sixth strap portion 136 to which the seventh portion of hook-and-loop fastener 142 is attached. The eighth portion of hook-and-loop fastener 144 is in the form of a panel designed for lying flat against a side of the sixth strap portion 136, which is opposite the side of the sixth strap portion 136 to which the seventh portion of hook-and-loop fastener 142 is attached.

When the second portion of a hook-and-loop fastener 118 and the fourth portion of a hook-and-loop fastener 126 are attached to the second strap portion 120 and when the seventh portion of a hook-and-loop fastener 142 and the eighth portion of a hook-and-loop fastener 144 are attached to the sixth strap portion 136, the first portion of a hook-and-loop fastener 116 can be engaged to the second portion of a hook-and-loop fastener 118, the third portion of a hook-and-loop fastener 124 can be engaged to the fourth portion of a hook-and-loop fastener 126, the fifth portion of a hook-and-loop fastener 138 can be engaged to the seventh portion of a hook-and-loop fastener 142, and the sixth portion of a hook-and-loop fastener 140 can be engaged to the eighth portion of a hook-and-loop fastener 144 to releasably secure the second strap portion 120 to the sixth strap portion 136 and to releasably secure the sixth strap portion 136 to the fourth and fifth strap portions 130 and 132.

When the second strap portion 120 is releasably secured to the sixth strap portion 136, a threshold tensile force required to separate the sixth strap portion 136 from the second strap portion 120 is lower than the tensile force that would be placed on the control lines for guiding a horse if a rider or driver entangled in the control lines for guiding a horse were to be dragged on the ground by the horse or the horse drawn vehicle. Accordingly, the sixth strap portion 136 will separate from the second strap portion 120, and thereby release an entangled rider or driver, rather than allow the rider or driver to be dragged on the ground by the horse or the horse drawn vehicle.

Preferably, when the sixth strap portion 136 is releasably secured to the fourth and fifth strap portions 130 and 132, a threshold tensile force required to separate the sixth strap portion 136 from the fourth strap portion 130 and the fifth strap portion 132 is lower than the tensile force that would be placed on the control lines for guiding a horse if a rider or driver entangled in the control lines for guiding a horse were to be dragged on the ground by the horse or the horse drawn vehicle. Accordingly, the sixth strap portion 136 will separate from the fourth and fifth strap portions 130 and 132, and thereby release an entangled rider or driver, rather than allow the rider or driver to be dragged on the ground by the horse or the horse drawn vehicle.

In the illustrated example, the third portion of a hook-and-loop fastener 124 is provided on a side of the third strap portion 122 that faces the first strap portion 114 and the first portion of a hook-and-loop fastener 116. Similarly, the first portion of a hook-and-loop fastener 116 is provided on a side of the first strap portion 114 that faces the third strap portion 122 and the third portion of a hook-and-loop fastener 124.

In the illustrated example, the fifth portion of a hook-and-loop fastener 138 is provided on a side of the fourth strap portion 130 that faces the fifth strap portion 132 and the sixth portion of a hook-and-loop fastener 140. Similarly, the sixth portion of a hook-and-loop fastener 140 is provided on a side of the fifth strap portion 132 that faces the fourth strap portion 130 and the fifth portion of a hook-and-loop fastener 138.

Figure 7:
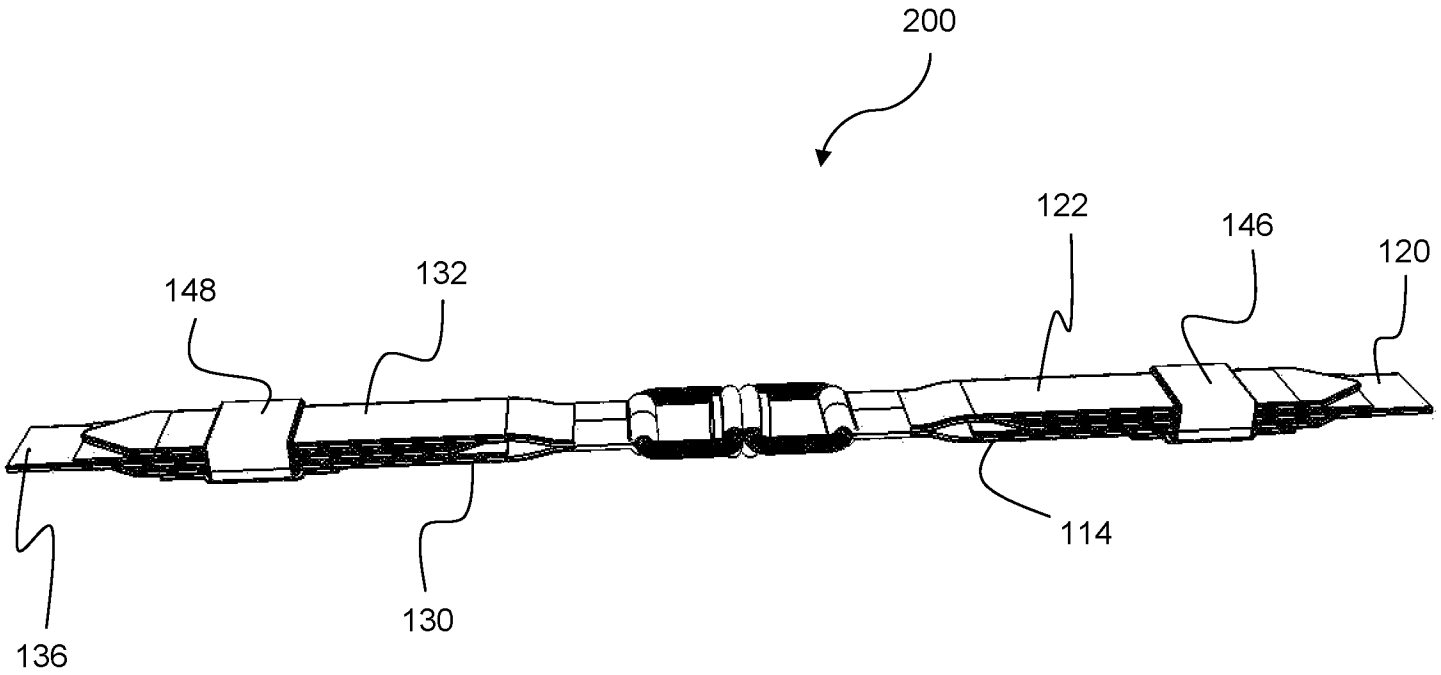
FIGS. 7-12 are views of a second embodiment of a safety device for connecting the ends of the control lines for controlling and guiding a horse in accordance with the present invention.
Figure 8:
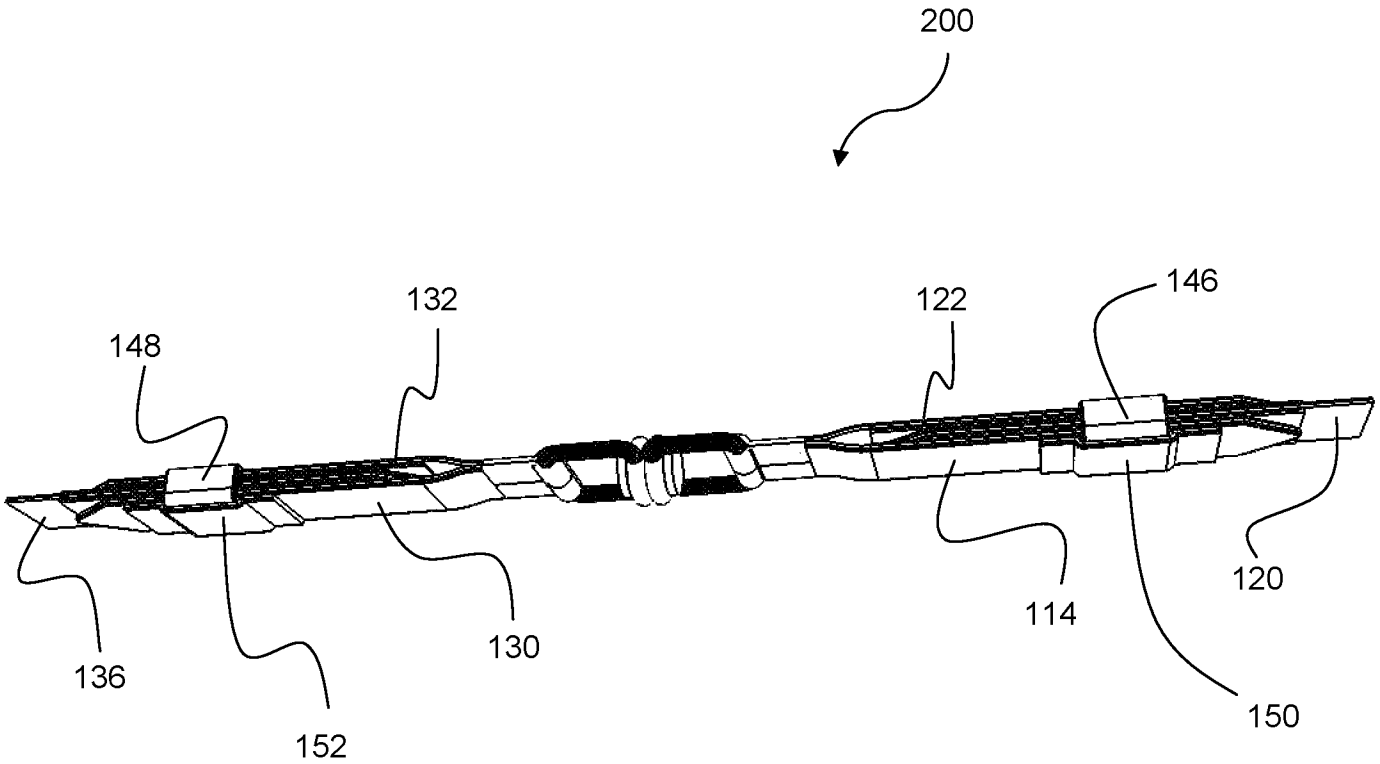
Figure 9:
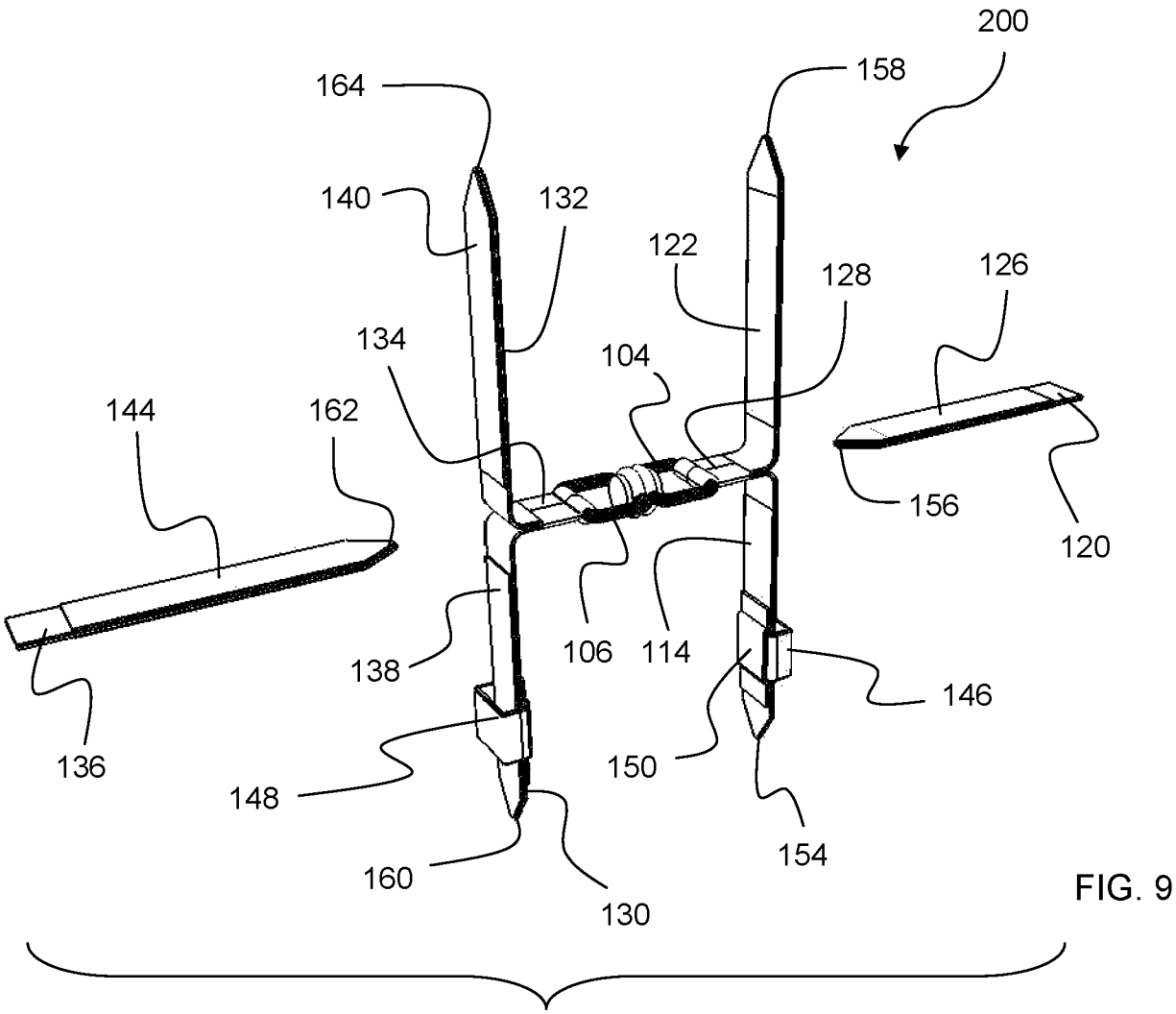
Figure 10:
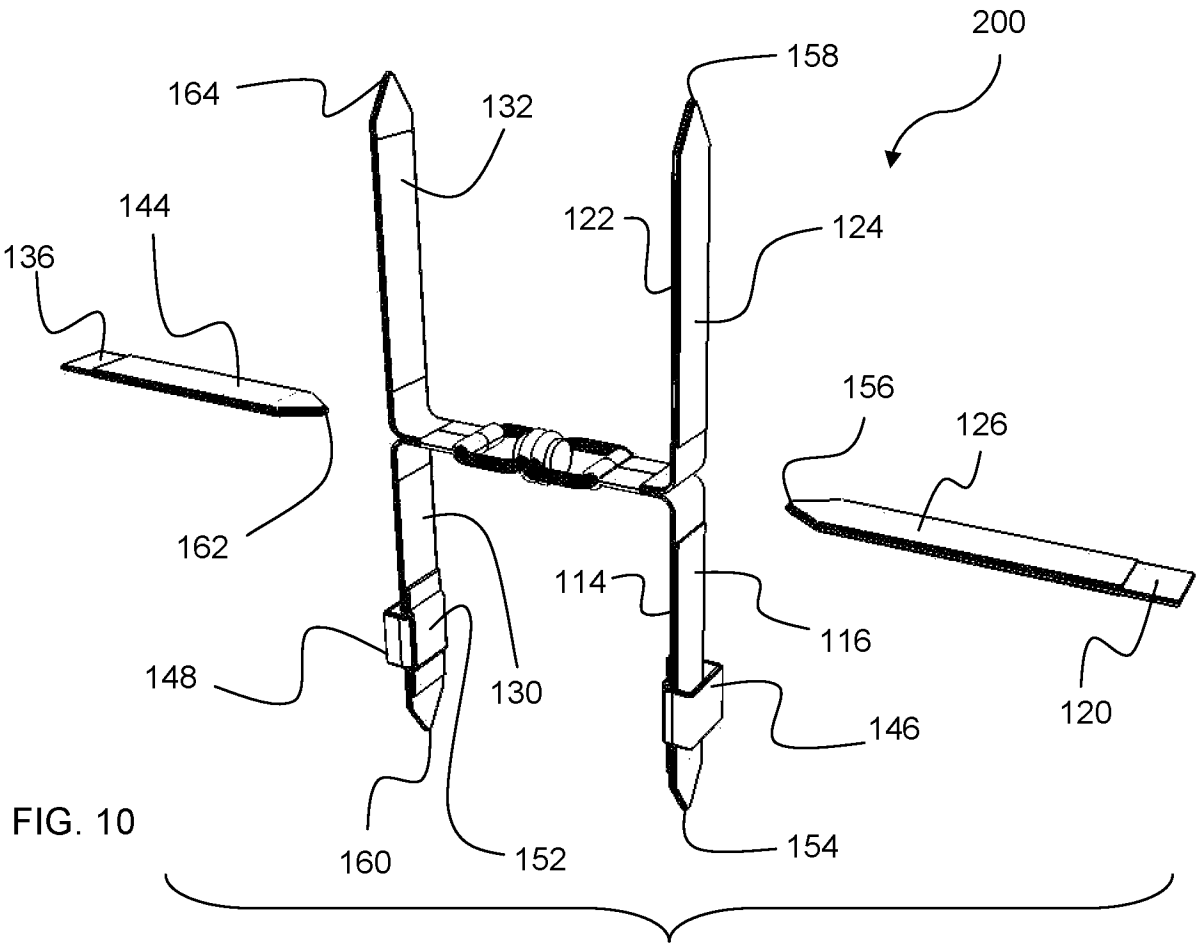
Figure 11:
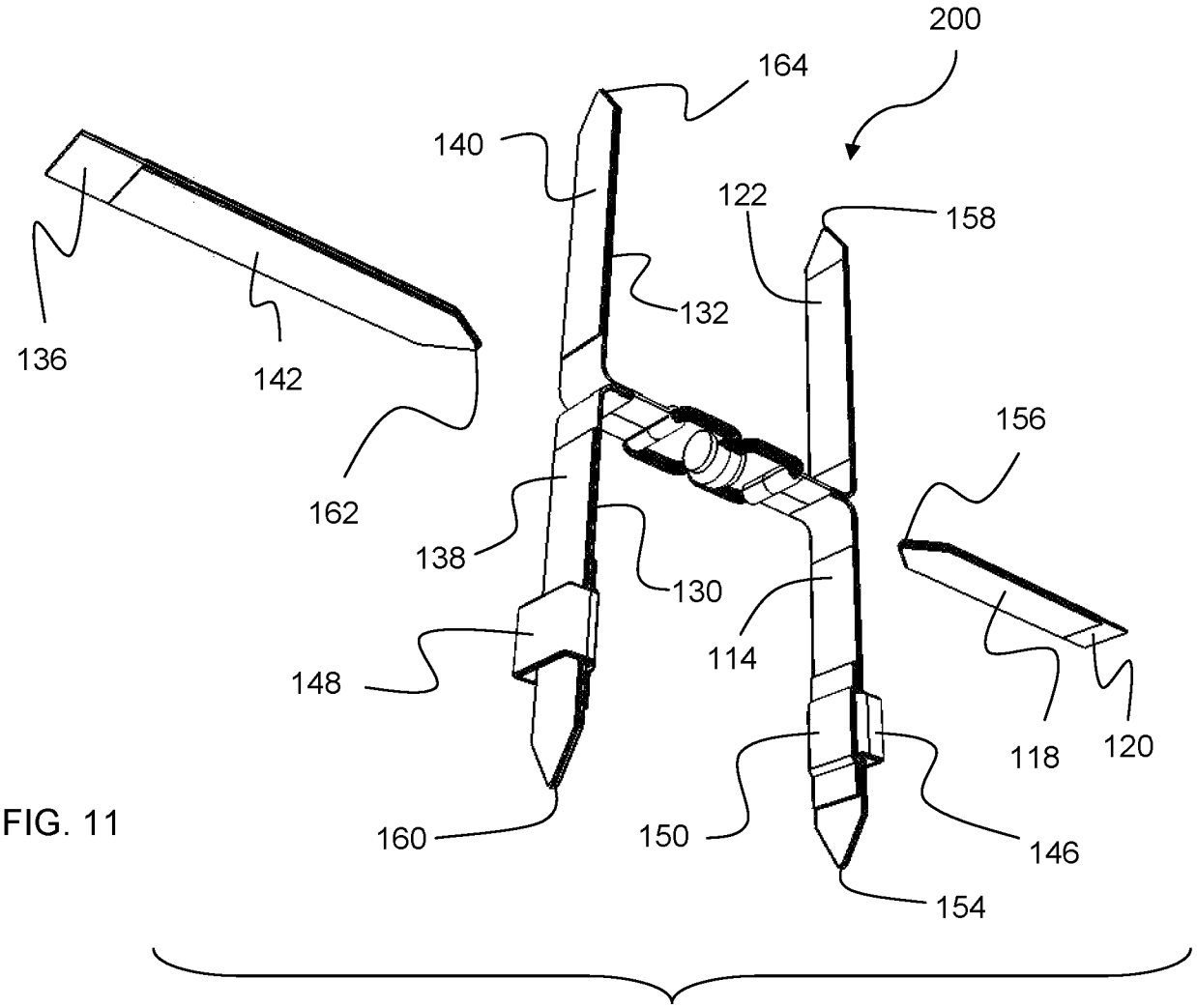
Figure 12:
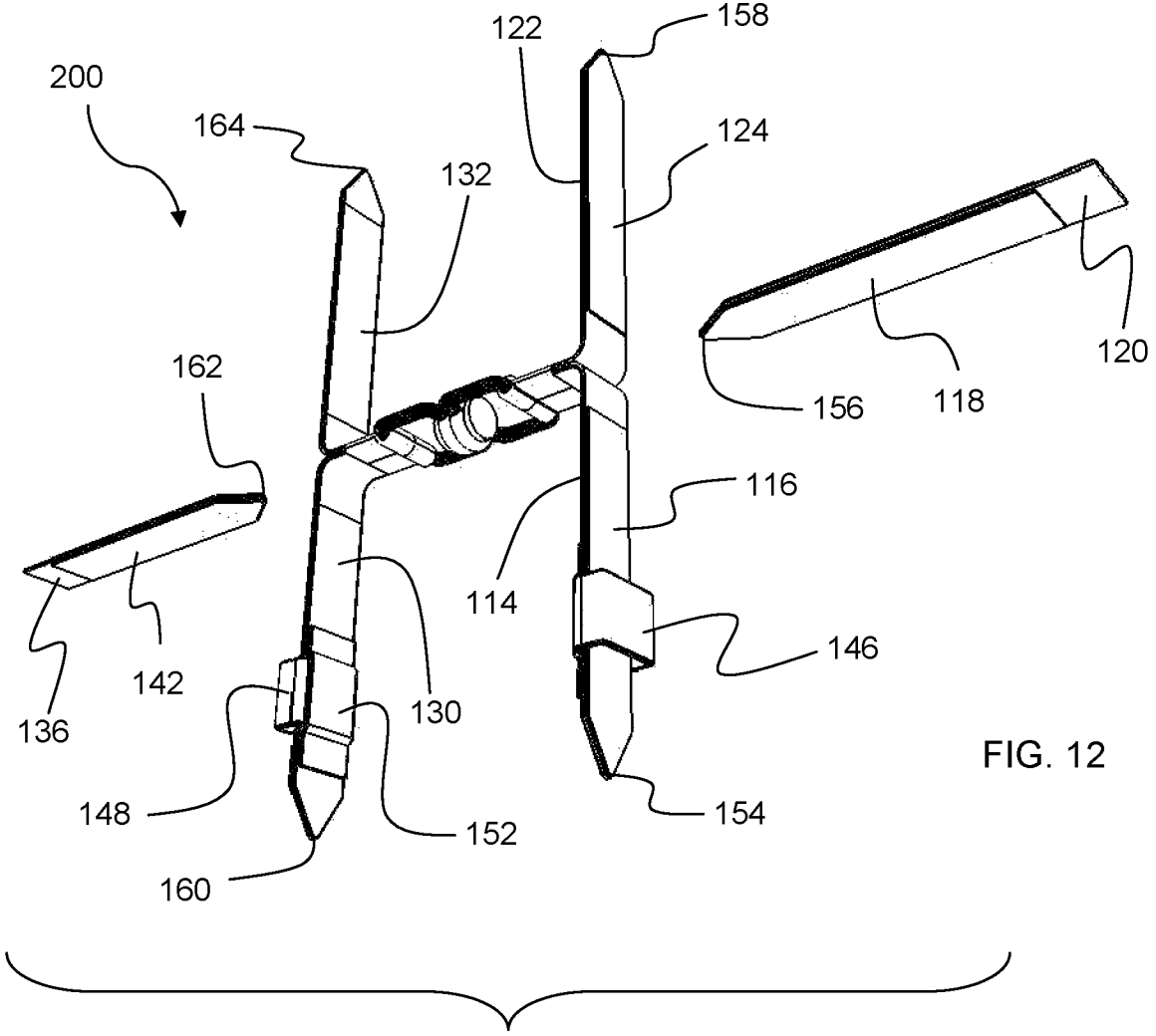

Referring to FIGS. 7-12, a second embodiment 200 in accordance with the present invention can be seen. The safety device 200 is identical to the safety device 100 except that the safety device 200 includes a first keeper 146 and a second keeper 148. The first keeper 146 is secured to the first strap portion 114 such that the third strap portion 122 and the second strap portion 120 extend through the first keeper 146 when the second portion of a hook-and-loop fastener 118 and the fourth portion of a hook-and-loop fastener 126 are attached to the second strap portion 120, the first portion of a hook-and-loop fastener 116 is engaged to the second portion of a hook-and-loop fastener 118, and the third portion of a hook-and-loop fastener 124 is engaged to the fourth portion of a hook-and-loop fastener 126.

The second keeper 148 is secured to the fourth strap portion 130 such that the fifth strap portion 132 and the sixth strap portion 136 extend through the second keeper 148 when the seventh portion of a hook-and-loop fastener 142 and the eighth portion of a hook-and-loop fastener 144 are attached to the sixth strap portion 136, the fifth portion of a hook-and-loop fastener 138 is engaged to the seventh portion of a hook-and-loop fastener 142, and the sixth portion of a hook-and-loop fastener 140 is engaged to the eighth portion of a hook-and-loop fastener 144. The first keeper 146 is secured to the first strap portion 114 at a fixed location along the first strap portion 114, and the second keeper 148 is secured to the fourth strap portion 130 at a fixed location along the fourth strap portion 130.

The first keeper 146 is captured between the side of the first strap portion 114 that is opposite the side to which the first portion of a hook-and-loop fastener 116 is attached and a first strip 150 that is attached to the first strap portion 114, for example by sewing, at the end portions of the first strip 150 on either side of the keeper 146. The second keeper 148 is captured between the side of the fourth strap portion 130 that is opposite the side to which the fifth portion of a hook-and-loop fastener 138 is attached and a second strip 152 that is attached to the fourth strap portion 130, for example by sewing, at the end portions second strip 152 on either side of the keeper 148.

Figure 13:
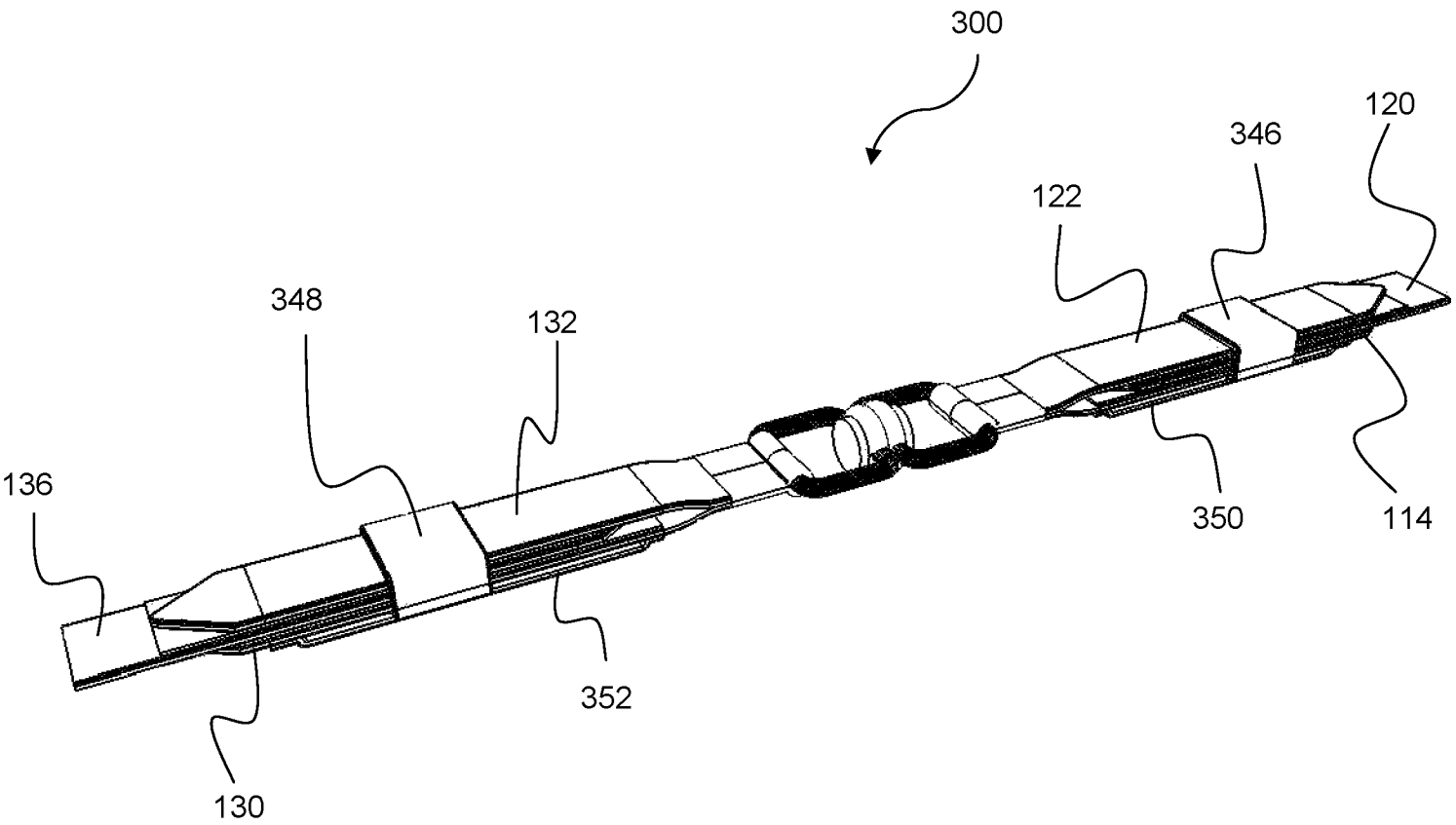
FIGS. 13-18 are views of a third embodiment of a safety device for connecting the ends of the control lines for controlling and guiding a horse in accordance with the present invention.
Figure 14:
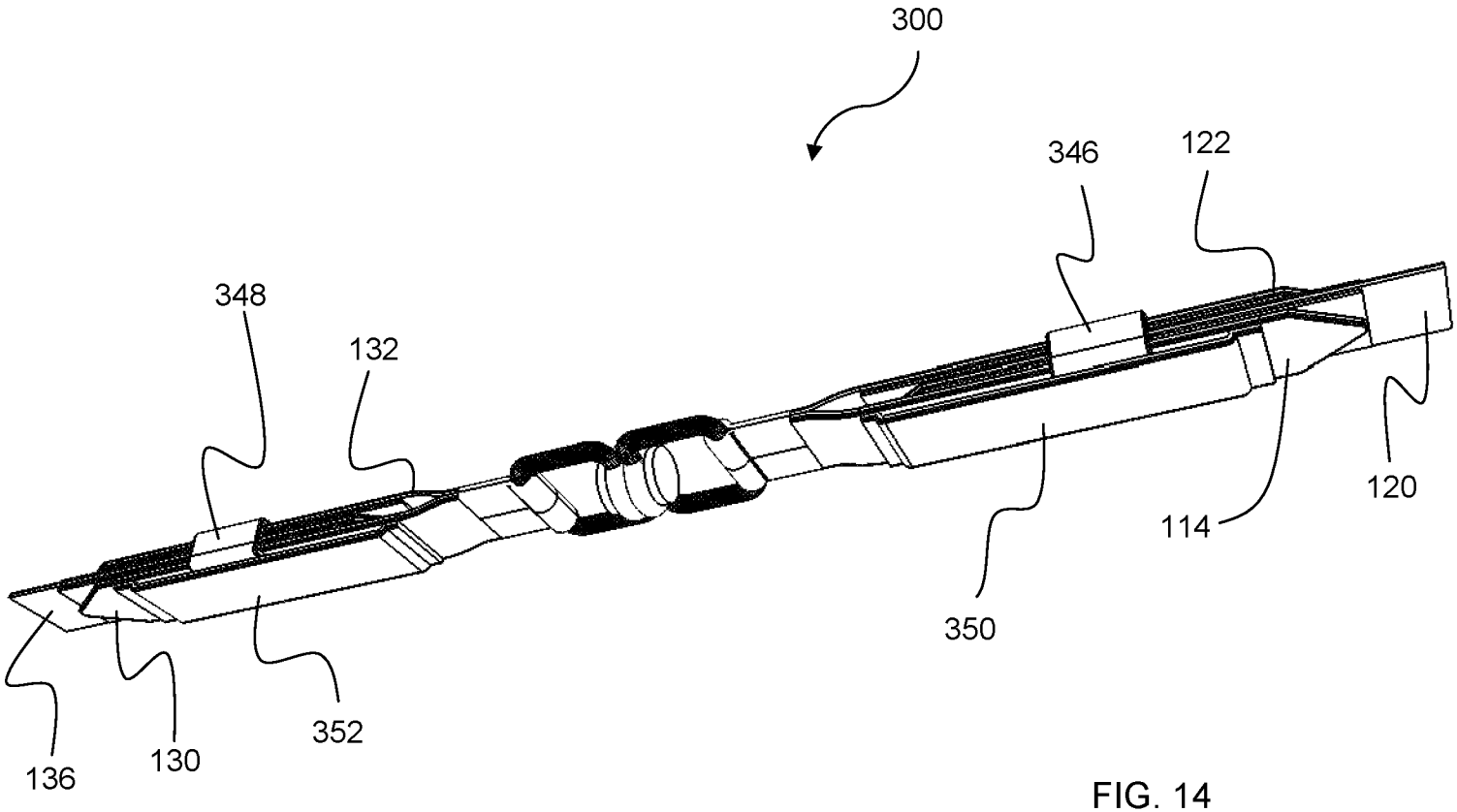
Figure 15:
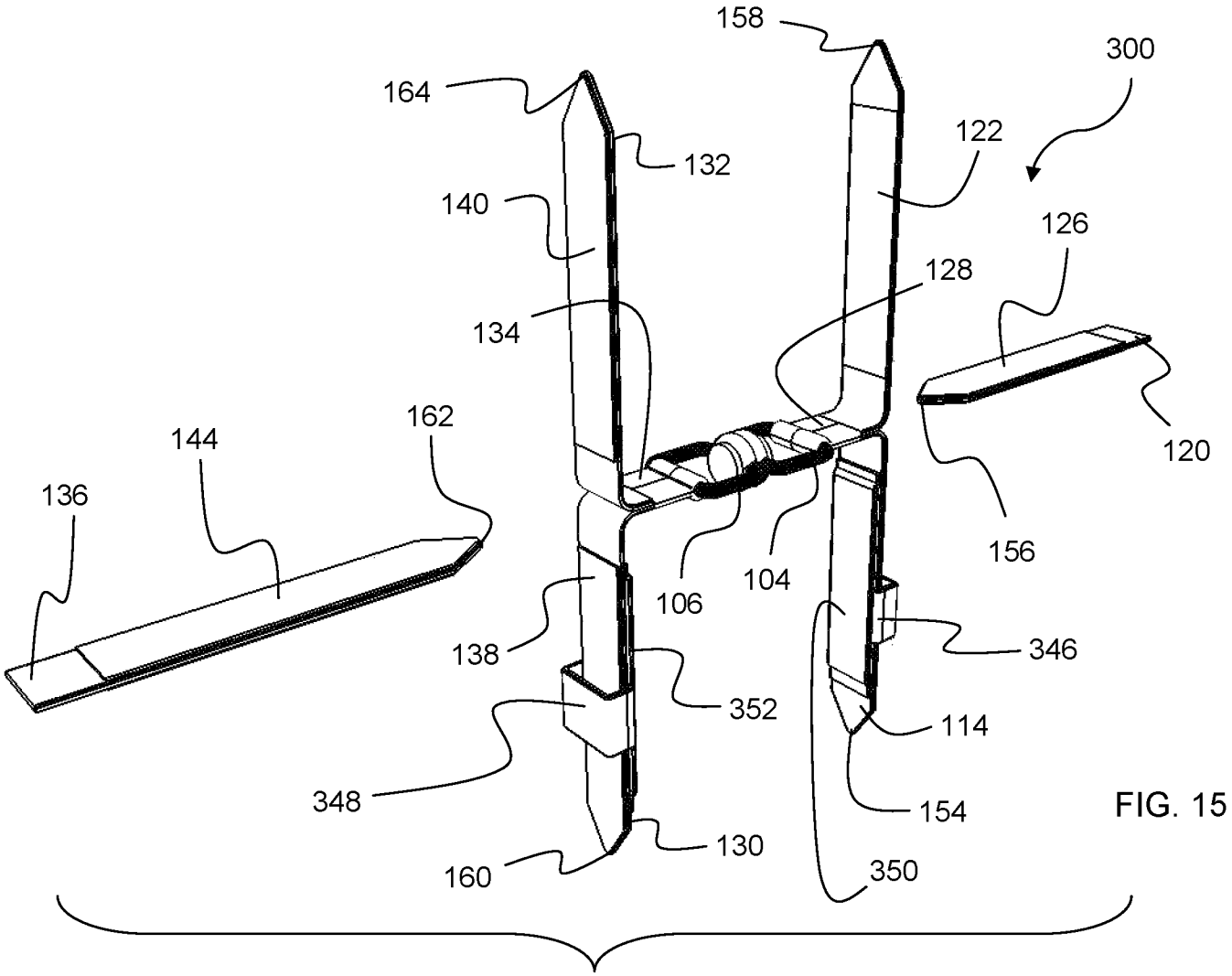
Figure 16:
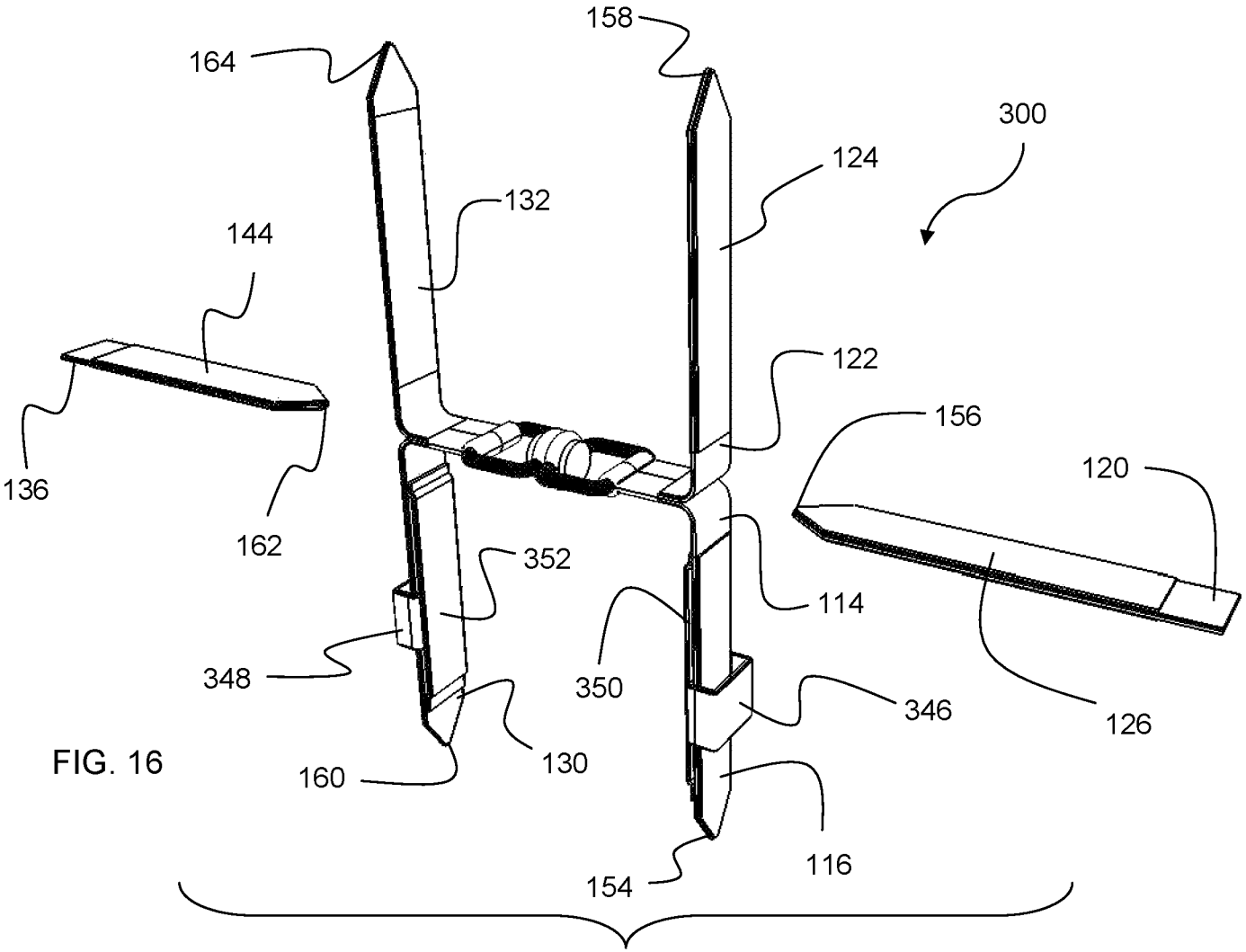
Figure 17:
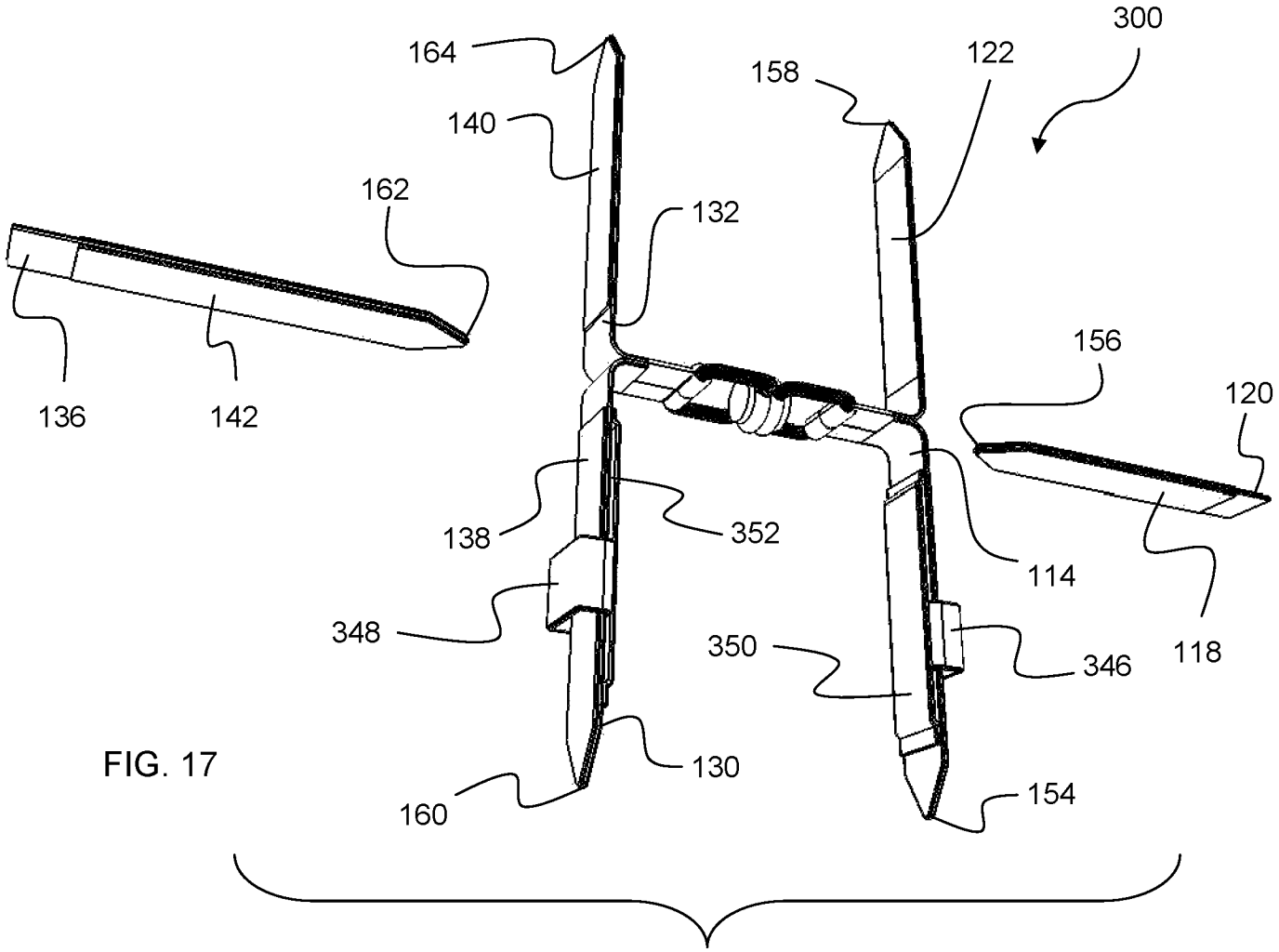
Figure 18:
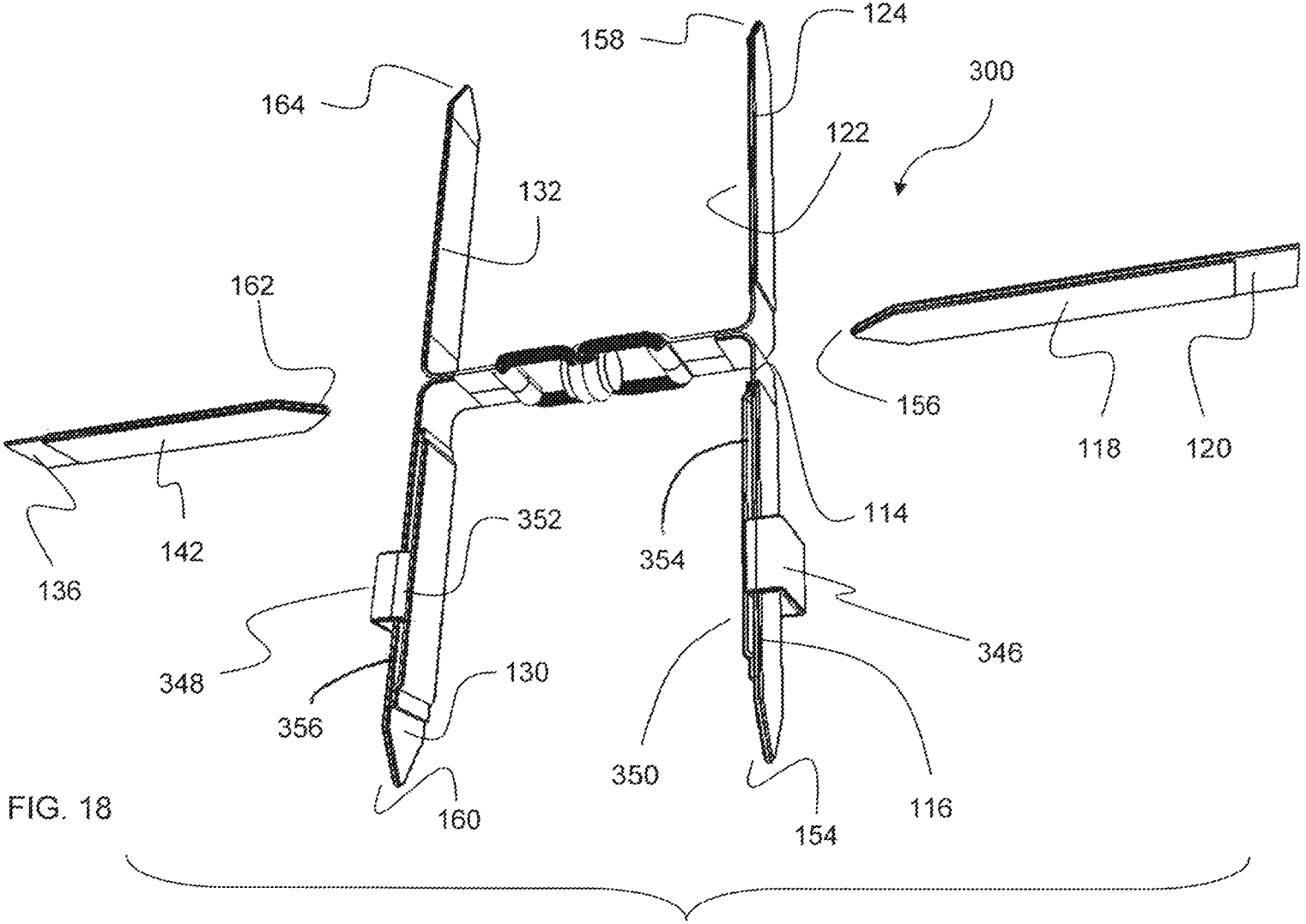

Referring to FIGS. 13-18, a third embodiment 300 in accordance with the present invention can be seen. The safety device 300 is identical to the safety device 200 except that the first keeper 346 is movable along at least a portion of the first strap portion 114, and the second keeper 348 is movable along at least a portion of the fourth strap portion 130.

The first keeper 346 is captured between the side of the first strap portion 114 that is opposite the side to which the first portion of a hook-and-loop fastener 116 is attached and a first elongated strip 350 that is attached to the first strap portion 114, for example by sewing, at the end portions of the first elongated strip 350 on either side of the keeper 346. The second keeper 348 is captured between the side of the fourth strap portion 130 that is opposite the side to which the fifth portion of a hook-and-loop fastener 138 is attached and a second elongated strip 352 that is attached to the fourth strap portion 130, for example by sewing, at the end portions of the second elongated strip 352 on either side of the keeper 348. Because the strips 350 and 352 are elongated, respective elongated slots 354 and 356 are created along portions of the lengths of the first strap portion 114 and the second strap portion 130. Accordingly, the keepers 346 and 348 can slide along the slots 354 and 356, respectively, and therefore the keepers 346 and 348 can also slide along at least a portion of the first and fourth strap portions 114 and 130, respectively. The optional keepers 346 and 348 can provide greater security to the connections between the second and fourth strap portions 120 and 136 and the safety device 300, if necessary. The optional movable keepers 346 and 348, in addition to greater security of the connections, can provide a degree of adjustability of the force required to separate the second and fourth strap portions 120 and 136 from the safety device 300, if desired.

In use, the strap portion 122 can be placed through the keeper 346 with the keeper 346 positioned at its closest position to the ring 104. The strap portions 122 and 114 are then spread apart and the strap portion 120 is placed between them. Then the strap portions 122 and 114 are pressed against the strap portion 120. This action causes the first portion of a hook-and-loop fastener 116 to engage the second portion of a hook-and-loop fastener 118 and the third portion of a hook-and-loop fastener 124 to engage the fourth portion of a hook-and-loop fastener 126 to thereby secure the strap portion 120 to the strap portions 122 and 114. The keeper 346 can then be moved along the first strap portion 114 away from the ring 104 in order to encircle at least both the strap portion 120 and the strap portion 122. By varying the position of the keeper 346 relative to the tip of the strap portion 120, the force required to separate the second strap portion 120 from the safety device 300 can be adjusted. A same procedure can be applied to the straps 130, 132, and 136 and the keeper 348 in order to adjust the force required to separate the fourth strap portion 136 from the safety device 300.

The first strap portion 114 has a tip 154 located distally from the first ring 104. A length of the first strap portion 114 extends between the first ring 104 and the tip 154 of the first strap portion 114. The first portion of hook-and-loop fastener 116 is provided on the length of the first strap portion 114 intermediate the tip 154 of the first strap portion 114 and the first ring 104. Preferably, the first portion of hook-and-loop fastener 116 is in the form of a panel of hook or loop material lying flat against one side of the first strap portion 114 intermediate the first ring 104 and the tip 154 of the first strap portion 114. The first portion of hook-and-loop fastener 116 may be attached to the first strap portion 114 using any suitable means including, without limitation, sewing or stitching, adhesives, rivets, snaps, buttons, and grommets. Sewing or stitching and adhesives are currently the most preferred means for attaching the first portion of hook-and-loop fastener 116 to the first strap portion 114.

The second strap portion 120 has a tip 156 located distally from the head portion (not shown) of the second control line for guiding the horse. A length of the second strap portion 120 extends from the tip 156 toward the head portion of the second control line. The second and fourth portions of hook-and-loop fastener 118 and 126 are provided on the length of the second strap portion 120 extending from the tip 156. Preferably, the second and fourth portions of hook-and-loop fastener 118 and 126 are in the form of panels of hook or loop material lying flat against respective sides of the second strap portion 120. The second and fourth portions of hook-and-loop fastener 118 and 126 may be attached to the second strap portion 120 using any suitable means including, without limitation, sewing or stitching, adhesives, rivets, snaps, buttons, and grommets. Sewing or stitching and adhesives are currently the most preferred means for attaching the second and fourth portions of hook-and-loop fastener 118 and 126 to the second strap portion 120. The second and fourth portions of hook-and-loop fastener 118 and 126 may be of the same type or of different types.

The third strap portion 122 has a tip 158 located distally from the first ring 104. A length of the third strap portion 122 extends between the first ring 104 and the tip 158 of the third strap portion 122. The third portion of hook-and-loop fastener 124 is provided on the length of the third strap portion 122 intermediate the tip 158 of the third strap portion 122 and the first ring 104. Preferably, the third portion of hook-and-loop fastener 124 is in the form of a panel of hook or loop material lying flat against one side of the third strap portion 122 intermediate the first ring 104 and the tip 158 of the third strap portion 122. The third portion of hook-and-loop fastener 124 may be attached to the third strap portion 122 using any suitable means including, without limitation, sewing or stitching, adhesives, rivets, snaps, buttons, and grommets. Sewing or stitching and adhesives are currently the most preferred means for attaching the third portion of hook-and-loop fastener 124 to the third strap portion 122.

The fourth strap portion 130 has a tip 160 located distally from the second ring 106. A length of the fourth strap portion 130 extends between the second ring 106 and the tip 160 of the fourth strap portion 130. The fifth portion of hook-and-loop fastener 138 is provided on the length of the fourth strap portion 130 intermediate the tip 160 of the fourth strap portion 130 and the second ring 106. Preferably, the fifth portion of hook-and-loop fastener 138 is in the form of a panel of hook or loop material lying flat against one side of the fourth strap portion 130 intermediate the second ring 106 and the tip 160 of the fourth strap portion 130. The fifth portion of hook-and-loop fastener 138 may be attached to the fourth strap portion 130 using any suitable means including, without limitation, sewing or stitching, adhesives, rivets, snaps, buttons, and grommets. Sewing or stitching and adhesives are currently the most preferred means for attaching the fifth portion of hook-and-loop fastener 138 to the fourth strap portion 130.

The sixth strap portion 136 has a tip 162 located distally from the head portion (not shown) of the first control line for guiding the horse. A length of the sixth strap portion 136 extends from the tip 162 toward the head portion of the first control line. The seventh and eighth portions of hook-and-loop fastener 142 and 144 are provided on the length of the sixth strap portion 136 extending from the tip 162. Preferably, the seventh and eighth portions of hook-and-loop fastener 142 and 144 are in the form of panels of hook or loop material lying flat against respective sides of the sixth strap portion 136. The seventh and eighth portions of hook-and-loop fastener 142 and 144 may be attached to the sixth strap portion 136 using any suitable means including, without limitation, sewing or stitching, adhesives, rivets, snaps, buttons, and grommets. Sewing or stitching and adhesives are currently the most preferred means for attaching the seventh and eighth portions of hook-and-loop fastener 142 and 144 to the sixth strap portion 136. The seventh and eighth portions of hook-and-loop fastener 142 and 144 may be of the same type or of different types.

The fifth strap portion 132 has a tip 164 located distally from the second ring 106. A length of the fifth strap portion 132 extends between the second ring 106 and the tip 164 of the fifth strap portion 132. The sixth portion of hook-and-loop fastener 140 is provided on the length of the fifth strap portion 132 intermediate the tip 164 of the fifth strap portion 132 and the second ring 106. Preferably, the sixth portion of hook-and-loop fastener 140 is in the form of a panel of hook or loop material lying flat against one side of the fifth strap portion 132 intermediate the second ring 106 and the tip 164 of the fifth strap portion 132. The sixth portion of hook-and-loop fastener 140 may be attached to the fifth strap portion 132 using any suitable means including, without limitation, sewing or stitching, adhesives, rivets, snaps, buttons, and grommets. Sewing or stitching and adhesives are currently the most preferred means for attaching the sixth portion of hook-and-loop fastener 140 to the fifth strap portion 132.

Each portion of hook-and-loop fastener has a woven, preferably rectangular backing material. If the portion of hook-and-loop fastener is of the hook type, then a fairly dense array of small hooks are provided on the top or exposed surface of the backing material. Each hook is formed of a semi-rigid, resilient, polymeric material that projects outward from the backing material.

If the portion of hook-and-loop fastener is of the loop type, then loosely woven or matted piles of fibers that form a mat of loops of fibers are provided over the top or exposed surface of the backing material. The hook type material and the loop type material are complementary in the sense that a hook type portion of hook-and-loop fastener cooperates with a loop type portion of hook-and-loop fastener to accomplish the fastening function. Fastening is accomplished by pressing the hook type portion of hook-and-loop fastener against the loop type portion of hook-and-loop fastener with the side of one fastener portion that has the array of hooks in face to face relationship with the side of the other fastener portion that has the mat of loops. The hooks become entangled in the loops to attach the fastener portions, and in turn whatever is attached to the fastener portions, to one another. The fastener portions can be pulled apart by force starting from one end of the fastener panels to the other end to accomplish release of the fastener.

The safety connector 100 may, for example, be used to releasably attach the ends of the control lines of a harness racing sulky. The threshold tensile force required to separate the ends of the control lines of the sulky that are attached together by the safety connector 100 is well below the tensile force that would be placed on the control lines if a rider or driver entangled in the control lines were to be dragged on the ground by the horse drawn sulky.

The safety connectors 100, 200, and 300 are easy to retrofit to existing control lines. In the illustrative examples, the portion of hook-and-loop fastener 116 is at least complementary with the portion of hook-and-loop fastener 118 so that the first strap portion 114 can be releasably attached to the second strap portion 120. The portion of hook-and-loop fastener 124 is at least complementary with the portion of hook-and-loop fastener 126 so that the third strap portion 122 can be releasably attached to the second strap portion 120.

In the illustrative examples, the portion of hook-and-loop fastener 138 is at least complementary with the portion of hook-and-loop fastener 142 so that the fourth strap portion 130 can be releasably attached to the sixth strap portion 136. The portion of hook-and-loop fastener 140 is at least complementary with the portion of hook-and-loop fastener 144 so that the fifth strap portion 132 can be releasably attached to the sixth strap portion 136.

The terms "sewn" or "sewing" as used in the appended claims should be construed as being a generic reference for sewn, stitched, sewing or stitching. The term "tip" as used herein simply refers to the free end of a strap portion, as opposed to the end of the strap portion that is directly or indirectly connected to the control lines for guiding a horse. Even though the illustrated embodiments show pointed tips, the term "tip" as used herein does not designate any particular shape and the tips of the strap portions may be rounded or rectangular or of any other suitable shape, unless otherwise specified. The references to first, second, third, fourth, etc. are used merely to ease distinguishing between different parts of the invention that have the same name such as strap portions or rings and are not to be associated with a particular direction such as left or right or with a particular one of the control lines for guiding horses. As used herein, the term "keeper" refers to a loop of material, usually at least resembling in form an endless loop formed of a strip, that is used for holding a portion of one strap portion that includes its tip flat against another strap portion. The keeper can be made of leather, simulated leather, rubber, plastic, or any other suitable material. Currently, leather is the preferred material for the keeper.

Similarly, the various strap portions and strips can be made of leather, simulated leather, rubber, plastic, or any other suitable material. Currently, leather is the preferred material for the various strap portions and strips used in the illustrative embodiments.

In all the illustrative embodiments, the force required to separate the second and fourth strap portions 120 and 136 from the safety device 100, 200, or 300 can be adjusted by varying the amount of overlap between the strap portion 120 and the strap portions 114 and 122 and between the strap portion 136 and the strap portions 130 and 132, respectively.

It is to be understood that the present invention is not limited to the embodiments described above, but encompasses any and all embodiments within the scope of the appended claims. In addition, the present invention encompasses any and all permutations of the various disclosed safety devices used in whole or in part as replacements for one or more parts of the various disclosed safety connectors.

The invention claimed is:

1. A safety device for use with control lines for guiding a horse, the control lines including at least a first control line and a second control line, the first control line having a head portion, the second control line having a head portion, the safety device comprising:

a first strap portion adapted to be operably connected to one of the head portion of the first control line and the head portion of the second control line;

a first portion of a hook-and-loop fastener attached to the first strap portion, the first portion of the hook-and-loop fastener being in the form of a panel lying flat against one side of the first strap portion;

a second portion of a hook-and-loop fastener adapted for attachment to a second strap portion, the second portion of the hook-and-loop fastener being in the form of a panel lying flat against one side of the second strap portion, wherein the second strap portion is operably connected to the other of the head portion of the first control line and the head portion of the second control line, wherein the second strap portion is part of the control lines for guiding a horse, and wherein, when said first strap portion is operably connected to a corresponding one of the head portion of the first control line and the head portion of the second control line, said first portion of a hook-and-loop fastener can be engaged to said second portion of a hook-and-loop fastener to releasably secure said first strap portion to the second strap portion;

wherein a threshold tensile force required to separate the first strap portion and the second strap portion is lower than the tensile force that would be placed on the control lines for guiding a horse if a rider or driver entangled in the control lines for guiding a horse were to be dragged on the ground by the horse or a horse drawn vehicle;

a third strap portion adapted to be operably connected to the one of the head portion of the first control line and the head portion of the second control line to which said first strap portion is adapted for connection;

a third portion of a hook-and-loop fastener attached to the third strap portion, the third portion of the hook-and-loop fastener being in the form of a panel lying flat against one side of the third strap portion; and a fourth portion of a hook-and-loop fastener adapted for attachment to the second strap portion, the fourth portion of the hook-and-loop fastener being in the form of a panel lying flat against one side of the second strap portion that is opposite the side of the second strap portion to which the second portion of a hook-and-loop fastener is attached, wherein the second strap portion can be received between said first strap portion and said third strap portion, said first portion of a hook-and-loop fastener can be engaged to said second portion of a hook-and-loop fastener, and said third portion of a hook-and-loop fastener can be engaged to said fourth portion of a hook-and-loop fastener in order to releasably secure the second strap portion to said first strap portion and said third strap portion, and wherein a threshold tensile force required to separate the second strap portion from said first strap portion and said third strap portion is lower than the tensile force that would be placed on the control lines for guiding a horse if the rider or driver entangled in the control lines for guiding a horse were to be dragged on the ground by the horse or the horse drawn vehicle.

2. The safety device according to claim 1, wherein said third portion of a hook-and-loop fastener is provided on a side of said third strap portion that faces said first strap portion, and wherein said first portion of a hook-and-loop fastener is provided on a side of said first strap portion that faces said third strap portion.

3. The safety device according to claim 1, wherein the second strap portion is operably connected to the head portion of the second control line and said first strap portion and said third strap portion are adapted for operable connection to the head portion of the first control line, the safety device further comprising:

a swivel comprising a first ring and a second ring that are rotatably connected to one another;

a first intermediate strap portion connecting said first strap portion to said third strap portion, wherein said first intermediate strap portion is routed through said first ring and its end portions secured together to thereby pivotally attach said first strap portion and said third strap portion to said first ring, wherein said first strap portion and said third strap portion form a forked arrangement for receiving the second strap portion between them;

a fourth strap portion;

a fifth strap portion;

a second intermediate strap portion connecting said fourth strap portion to said fifth strap portion, wherein said second intermediate strap portion is routed through said second ring and its end portions secured together to thereby pivotally attach said fourth strap portion and said fifth strap portion to said second ring, wherein said fourth strap portion and said fifth strap portion form a forked arrangement for receiving a sixth strap portion between them, wherein the sixth strap portion is operably connected to the head portion of the first control line and wherein the sixth strap portion is part of the control lines for guiding a horse;

a fifth portion of a hook-and-loop fastener attached to the fourth strap portion, the fifth portion of the hook-and-loop fastener being in the form of a panel lying flat against one side of the fourth strap portion;

a sixth portion of a hook-and-loop fastener attached to the fifth strap portion, the sixth portion of the hook-and-loop fastener being in the form of a panel lying flat against one side of the fifth strap portion;

a seventh portion of a hook-and-loop fastener adapted for attachment to one side of the sixth strap portion, the seventh portion of the hook-and-loop fastener being in the form of a panel lying flat against the one side of the sixth strap portion; and an eighth portion of a hook-and-loop fastener adapted for attachment to an opposite side of the sixth strap portion relative to the seventh portion of a hook-and-loop fastener, the eighth portion of the hook-and-loop fastener being in the form of a panel lying flat against the opposite side of the sixth strap portion, wherein, when said second portion of a hook-and-loop fastener and said fourth portion of a hook-and-loop fastener are attached to the second strap portion and when said seventh portion of a hook-and-loop fastener and said eighth portion of a hook-and-loop fastener are attached to the sixth strap portion, said first portion of a hook-and-loop fastener can be engaged to said second portion of a hook-and-loop fastener, said third portion of a hook-and-loop fastener can be engaged to said fourth portion of a hook-and-loop fastener, said fifth portion of a hook-and-loop fastener can be engaged to said seventh portion of a hook-and-loop fastener, and said sixth portion of a hook-and-loop fastener can be engaged to said eighth portion of a hook-and-loop fastener to releasably secure the second strap portion to the sixth strap portion and to releasably secure the sixth strap portion to said fourth and fifth strap portions, and wherein, when the second strap portion is releasably secured to the sixth strap portion, a threshold tensile force required to separate the sixth strap portion from the second strap portion is lower than the tensile force that would be placed on the control lines for guiding a horse if a rider or driver entangled in the control lines for guiding a horse were to be dragged on the ground by the horse or the horse drawn vehicle.

4. The safety device according to claim 3, wherein, when the sixth strap portion is releasably secured to said fourth and fifth strap portions, a threshold tensile force required to separate the sixth strap portion from said fourth strap portion and said fifth strap portion is lower than the tensile force that would be placed on the control lines for guiding a horse if a rider or driver entangled in the control lines for guiding a horse were to be dragged on the ground by the horse or the horse drawn vehicle.

5. The safety device according to claim 3, wherein said third portion of a hook-and-loop fastener is provided on a side of said third strap portion that faces said first strap portion, and wherein said first portion of a hook-and-loop fastener is provided on a side of said first strap portion that faces said third strap portion, and wherein said fifth portion of a hook-and-loop fastener is provided on a side of said fourth strap portion that faces said fifth strap portion, and wherein said sixth portion of a hook-and-loop fastener is provided on a side of said fifth strap portion that faces said fourth strap portion.

6. The safety device according to claim 3, wherein the first and second rings of the swivel are rotationally connected by a pivot pin and the first and second rings can rotate freely relative to one another.

7. The safety device according to claim 6, wherein the pivot pin has a journal portion having a longitudinal axis wherein at least one of the first and second rings rotate about the journal portion of the pivot pin.

8. The safety device according to claim 7, wherein the longitudinal axis of the journal portion of the pivot pin about which at least one of the first and second rings rotates defines the axis of rotation of the first and second rings relative to one another.

9. The safety device according to claim 6, wherein the first and second rings are positioned side by side along an axis of rotation defined by the pivot pin.

10. The safety device according to claim 6, wherein the first and second rings being positioned in tandem one after another in a direction coincident with the axis of rotation defined by the pivot pin.

11. The safety device according to claim 6, wherein each of the first and second rings defines a respective opening and wherein the axis of rotation defined by the pivot pin approximately bisects the opening of each of the first and second rings.

12. The safety device according to claim 1, wherein the second strap portion is operably connected to the head portion of the second control line and said first strap portion and said third strap portion are adapted for operable connection to the head portion of the first control line, the safety device further comprising:

a swivel comprising a first ring and a second ring that are rotatably connected to one another, wherein said first strap portion and said third strap portion are attached to said first ring, wherein said first strap portion and said third strap portion can receive the second strap portion between them;

a fourth strap portion;

a fifth strap portion, wherein said fourth strap portion and said fifth strap portion are attached to said second ring, wherein said fourth strap portion and said fifth strap portion can receive a sixth strap portion between them, wherein the sixth strap portion is operably connected to the head portion of the first control line and wherein the sixth strap portion is part of the control lines for guiding a horse;

a fifth portion of a hook-and-loop fastener attached to the fourth strap portion, the fifth portion of the hook-and-loop fastener being in the form of a panel lying flat against one side of the fourth strap portion;

a sixth portion of a hook-and-loop fastener attached to the fifth strap portion, the sixth portion of the hook-and-loop fastener being in the form of a panel lying flat against one side of the fifth strap portion;

a seventh portion of a hook-and-loop fastener adapted for attachment to one side of the sixth strap portion, the seventh portion of the hook-and-loop fastener being in the form of a panel lying flat against the one side of the sixth strap portion; and an eighth portion of a hook-and-loop fastener adapted for attachment to an opposite side of the sixth strap portion relative to the seventh portion of a hook-and-loop fastener, the eighth portion of the hook-and-loop fastener being in the form of a panel lying flat against the opposite side of the sixth strap portion, wherein, when said second portion of a hook-and-loop fastener and said fourth portion of a hook-and-loop fastener are attached to the second strap portion and when said seventh portion of a hook-and-loop fastener and said eighth portion of a hook-and-loop fastener are attached to the sixth strap portion, said first portion of a hook-and-loop fastener can be engaged to said second portion of a hook-and-loop fastener, said third portion of a hook-and-loop fastener can be engaged to said fourth portion of a hook-and-loop fastener, said fifth portion of a hook-and-loop fastener can be engaged to said seventh portion of a hook-and-loop fastener, and said sixth portion of a hook-and-loop fastener can be engaged to said eighth portion of a hook-and-loop fastener to releasably secure the second strap portion to the sixth strap portion and to releasably secure the sixth strap portion to said fourth and fifth strap portions, and wherein, when the second strap portion is releasably secured to the sixth strap portion, a threshold tensile force required to separate the sixth strap portion from the second strap portion is lower than the tensile force that would be placed on the control lines for guiding a horse if a rider or driver entangled in the control lines for guiding a horse were to be dragged on the ground by the horse or the horse drawn vehicle.

13. The safety device according to claim 12, wherein, when the sixth strap portion is releasably secured to the fourth and fifth strap portions, a threshold tensile force required to separate the sixth strap portion from said fourth strap portion and said fifth strap portion is lower than the tensile force that would be placed on the control lines for guiding a horse if a rider or driver entangled in the control lines for guiding a horse were to be dragged on the ground by the horse or the horse drawn vehicle.

14. The safety device according to claim 12, wherein said third portion of a hook-and-loop fastener is provided on a side of said third strap portion that faces said first strap portion, and wherein said first portion of a hook-and-loop fastener is provided on a side of said first strap portion that faces said third strap portion, and wherein said fifth portion of a hook-and-loop fastener is provided on a side of said fourth strap portion that faces said fifth strap portion, and wherein said sixth portion of a hook-and-loop fastener is provided on a side of said fifth strap portion that faces said fourth strap portion.

15. The safety device according to claim 1, wherein a complementary portion of hook-and-loop fastener adapted for attachment to a third strap portion of hook-and-loop fastener being complementary to the first portion of hook-and-loop fastener, the third strap portion being operably connected to one of the head portion of the first control line and head portion of the second control line.

16. The safety device of claim 15, wherein the complementary portion of the hook-and-loop fastener being in the form of a panel that can lie flat against one side of the third strap portion when the complementary portion of the hook-and-loop fastener is attached to the third strap portion.

17. The safety device of claim 15, wherein the complementary portion of the hook-and-loop fastener is attached to the third strap portion and the first portion of the hook-and-loop fastener is fastened to the complementary portion of the hook-and-loop fastener.

18. The safety device of claim 1, wherein a threshold tensile force required to separate the first strap portion and the third strap portion is lower than the tensile force that would be placed on the control lines for guiding a horse if a rider or driver entangled in the control lines for guiding a horse were to be dragged on the ground by the horse or the horse drawn vehicle.

19. A safety device for use with control lines for guiding a horse, the control lines including at least a first control line and a second control line, the first control line having a head portion, the second control line having a head portion, the safety device comprising:

a first strap portion adapted to be operably connected to one of the head portion of the first control line and the head portion of the second control line;

a first portion of a hook-and-loop fastener attached to the first strap portion, the first portion of the hook-and-loop fastener being in the form of a panel lying flat against one side of the first strap portion;

a second portion of a hook-and-loop fastener adapted for attachment to a second strap portion, the second portion of the hook-and-loop fastener being in the form of a panel lying flat against one side of the second strap portion, wherein the second strap portion is operably connected to the other of the head portion of the first control line and the head portion of the second control line, wherein the second strap portion is part of the control lines for guiding a horse, and wherein, when said first strap portion is operably connected to a corresponding one of the head portion of the first control line and the head portion of the second control line, said first portion of a hook-and-loop fastener can be engaged to said second portion of a hook-and-loop fastener to releasably secure said first strap portion to the second strap portion;

wherein a threshold tensile force required to prate the first strap portion and the second strap portion is lower than the tensile force that would be placed on the control lines for guiding a horse if a rider or driver entangled in the control lines for guiding a horse were to be dragged on the ground by the horse or a horse drawn vehicle, wherein the second strap portion is operably connected to the head portion of the second control line and said first strap portion is adapted for operable connection to the head portion of the first control line, the safety device further comprising:

a swivel comprising a first ring and a second ring that are rotatably connected to one another, wherein said first strap portion is attached to said first ring;

a third strap portion attached to said second ring;

a third portion of a hook-and-loop fastener attached to the third strap portion, the third portion of the hook-and-loop fastener being in the form of a panel lying flat against one side of the third strap portion; and a fourth portion of a hook-and-loop fastener attached to a fourth strap portion, the fourth portion of the hook-and-loop fastener being in the form of a panel lying flat against one side of the fourth strap portion, wherein the fourth strap portion is operably connected to the head portion of the first control line and wherein the fourth strap portion is part of the control lines for guiding a horse, wherein, when said second portion of a hook-and-loop fastener is attached to the second strap portion and when said fourth portion of a hook-and-loop fastener is attached to the fourth strap portion, said first portion of a hook-and-loop fastener can be engaged to said second portion of a hook-and-loop fastener and said third portion of a hook-and-loop fastener can be engaged to said fourth portion of a hook-and-loop fastener to releasably secure the second strap portion to the fourth strap portion and to releasably secure the fourth strap portion to said third strap portion, and wherein, when the second strap portion is releasably secured to the fourth strap portion, a threshold tensile force required to separate the fourth strap portion from the second strap portion is lower than the tensile force that would be placed on the control lines for guiding a horse if the rider or driver entangled in the control lines for guiding a horse were to be dragged on the ground by the horse or the horse drawn vehicle.

20. The safety device according to claim 19, wherein, when the fourth strap portion is releasably secured to said third strap portion, a threshold tensile force required to separate the fourth strap portion from said third strap portion is lower than the tensile force that would be placed on the control lines for guiding a horse if a rider or driver entangled in the control lines for guiding a horse were to be dragged on the ground by the horse or the horse drawn vehicle.

21. The safety device according to claim 19, wherein the first and second rings of the swivel are rotationally connected by a pivot pin and the first and second rings can rotate freely relative to one another.

22. The safety device according to claim 21, wherein the pivot pin has a journal portion having a longitudinal axis wherein at least one of the first and second rings rotate about the journal portion of the pivot pin.

23. The safety device according to claim 22, wherein the longitudinal axis of the journal portion of the pivot pin about which at least one of the first and second rings rotates defines the axis of rotation of the first and second rings relative to one another.

24. The safety device according to claim 21, wherein the first and second rings are positioned side by side along an axis of rotation defined by the pivot pin.

25. The safety device according to claim 21, wherein the first and second rings are positioned in tandem one after another in a direction coincident with the axis of rotation defined by the pivot pin.

26. The safety device according to claim 21, wherein each of the first and second rings defines a respective opening and wherein the axis of rotation defined by the pivot pin approximately bisects the opening of each of the first and second rings.

* * * * *